US005265662A

United States Patent [19]

Hirao et al.

[11] Patent Number: 5,265,662

[45] Date of Patent: Nov. 30, 1993

[54] SHUTTER CURTAIN FOR A BUILDING OPENING

[75] Inventors: Masato Hirao; Yasunori Kobayashi; Noriaki Tokuyama, all of Tokyo, Japan

[73] Assignee: Sanwa Shutter Corporation, Tokyo, Japan

[21] Appl. No.: 731,075

[22] Filed: Jul. 16, 1991

[30] Foreign Application Priority Data

| | | | |
|---|---|---|---|
| Jul. 21, 1990 | [JP] | Japan | 2-193254 |
| Jul. 21, 1990 | [JP] | Japan | 2-193255 |
| Aug. 29, 1990 | [JP] | Japan | 2-227229 |
| Aug. 31, 1990 | [JP] | Japan | 2-231422 |
| Aug. 31, 1990 | [JP] | Japan | 2-231436 |
| Aug. 31, 1990 | [JP] | Japan | 2-231437 |
| Aug. 31, 1990 | [JP] | Japan | 2-231438 |
| Aug. 31, 1990 | [JP] | Japan | 2-231443 |
| Sep. 5, 1990 | [JP] | Japan | 2-235030 |
| Sep. 5, 1990 | [JP] | Japan | 2-235031 |
| Sep. 5, 1990 | [JP] | Japan | 2-235033 |
| Sep. 5, 1990 | [JP] | Japan | 2-235034 |
| Sep. 8, 1990 | [JP] | Japan | 2-238519 |
| Sep. 8, 1990 | [JP] | Japan | 2-238522 |
| Sep. 8, 1990 | [JP] | Japan | 2-238523 |

[51] Int. Cl.[5] ..... E06B 9/08

[52] U.S. Cl. ..... 160/133; 160/236

[58] Field of Search ..... 160/133, 32, 33, 232, 160/236, 231.1, 231.2, 229.1

[56] References Cited

U.S. PATENT DOCUMENTS

| | | | |
|---|---|---|---|
| 1,936,300 | 11/1933 | Guss | 160/133 |
| 2,572,257 | 10/1951 | Gerner et al. | 160/133 X |
| 2,812,813 | 11/1957 | Zarnowski | 160/133 X |
| 3,076,499 | 2/1963 | Zoll et al. | 160/133 X |
| 3,254,462 | 6/1966 | Toler | 60/231.2 X |
| 3,527,283 | 9/1970 | Butler et al. | 160/232 X |
| 3,529,650 | 9/1970 | Brancato | 160/133 |
| 3,648,755 | 3/1972 | Thiele | 160/229.1 X |
| 3,908,731 | 9/1975 | Runka | 160/231.2 |
| 4,345,635 | 8/1982 | Solomon | 160/133 |
| 4,690,193 | 9/1987 | Morrison et al. | 160/133 |

*Primary Examiner*—David M. Purol

*Attorney, Agent, or Firm*—Oliff & Berridge

[57] ABSTRACT

A shutter curtain for an opening such as a window or door of a building comprising: slats each of which is made of materials having different rigidity values, wherein the shutter curtain is formed by arranging the slats in series. Furthermore, the shutter curtain for a building opening comprising: main slats made of a rigid material; and sub-slats made of a material having elasticity, wherein two end portions of the main and sub-slats are connected in series so that the shutter curtain is constituted.

58 Claims, 25 Drawing Sheets

P

Q

R

S

4''
5'
7

A

B

C

D

A

C

E

B

D

A

B

C

SHUTTER CURTAIN FOR A BUILDING OPENING

BACKGROUND OF THE INVENTION

1. Field of the Invention

The present invention relates to a shutter curtain for a building opening, such as a window or door, fitted to a building such as a house or an office building.

2. Description of Related Art

A shutter curtain for a building opening is usually wound to, for example, a take-up drum and it is raised/-lowered while being guided by guide rails formed on the two vertical end portions of an opening of the building. The shutter curtain must be constituted in such a manner that it can be curved so as to be wound to the take-up drum from an attitude of a straight line along the guide rails. Accordingly, a conventional shutter curtain is constituted by interlocked slats each of which is formed by bending an elongated plate, so that it can be curved. However, a problem arises in the conventional shutter curtain in that noise cannot be eliminated when the shutter curtain is raised/lowered or it receives wind when it is lowered because the interlocked portions involve a gap which will result in looseness.

Accordingly, although an attempt has been made to eliminate the gaps in the interlocked portions, another problem arises in that the structure of the interlocked portion becomes too complicated to be used practically.

SUMMARY OF THE INVENTION

To this end, an object of the present invention is to provide a shutter curtain for a building capable of overcoming the above-described problems.

According to one aspect of the present invention, a shutter curtain for a building opening comprises: slats each of which is made of materials having different rigidity values, wherein the shutter curtain is formed by arranging the slats in series.

According to another aspect of the present invention, is to provide a shutter curtain for a building opening for raising/lowering the essential portion, the shutter curtain for a building opening comprises: main slats made of a rigid material and sub-slats made of a material having elasticity, wherein two end portions of the main and sub-slats are connected in series to constitute the shutter curtain.

In accordance with the present invention, noise can be eliminated from the interlocked portions due to the herein described structure.

The shutter curtain according to the present invention is capable of eliminating the gaps in the junctions between the slats to a significant degree, in comparison to the conventional structure in which rigid slats are connected by interlocking them in such a manner that the slats can be folded. Therefore, noise generated due to the collision of the slats when the shutter curtain is being raised/lowered or the same receives wind can be eliminated. As a result, a silent, that is, a low-noise type shutter for a building opening can be realized. Furthermore, since there is no gap in the junctions between the slats, a corollary effect in terms of preventing fire, stopping smoke and insulating sound can be obtained. Further, when the shutter curtain embodied herein is wound to a take-up drum, the sub-slats having elasticity and flexibility are curved in place of the main slats. Therefore, it can be smoothly wound to the winding drum to form a coil-like shape as is achieved by the conventional interlock type shutter curtain.

BRIEF DESCRIPTION OF THE DRAWINGS

The aforesaid and other objects and advantages of the instant invention will become more apparent from a review of the following detailed description when taken in conjunction with the accompanying drawings, wherein.

DESCRIPTION OF THE PREFERRED EMBODIMENTS

Figure 1:
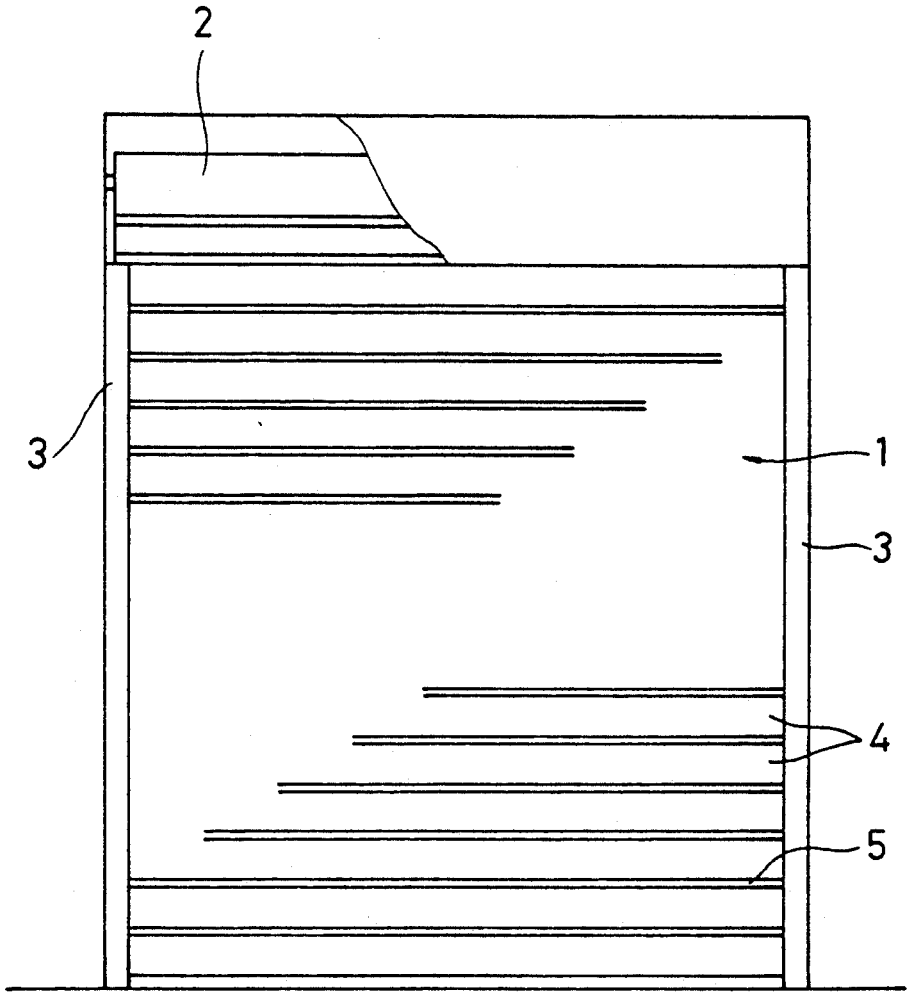
FIG. 1 is a schematic front elevational view which illustrates a shutter curtain for a building opening.
Figure 2:
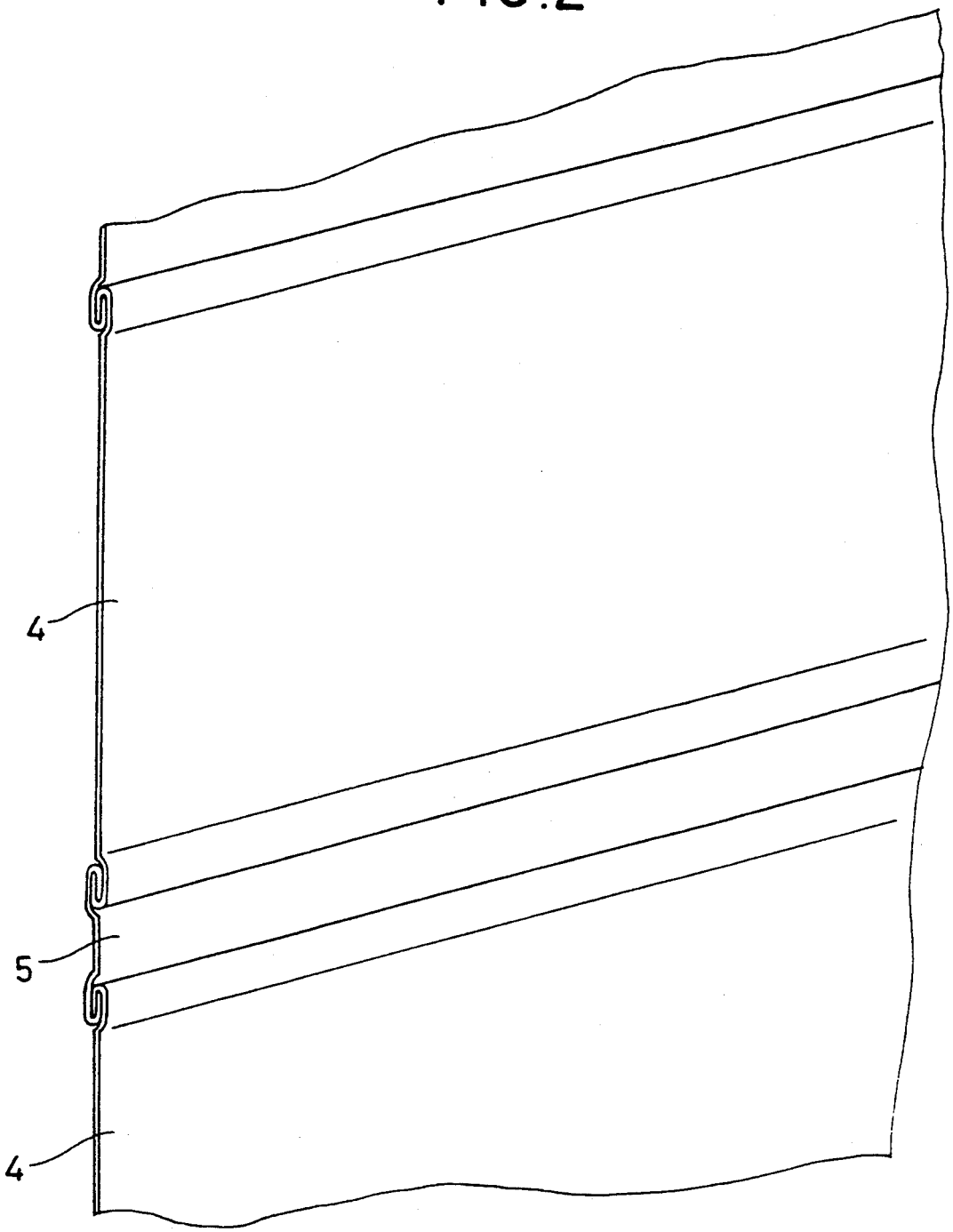
FIG. 2 is a perspective view which illustrates an essential portion of the shutter curtain.
Figure 3:
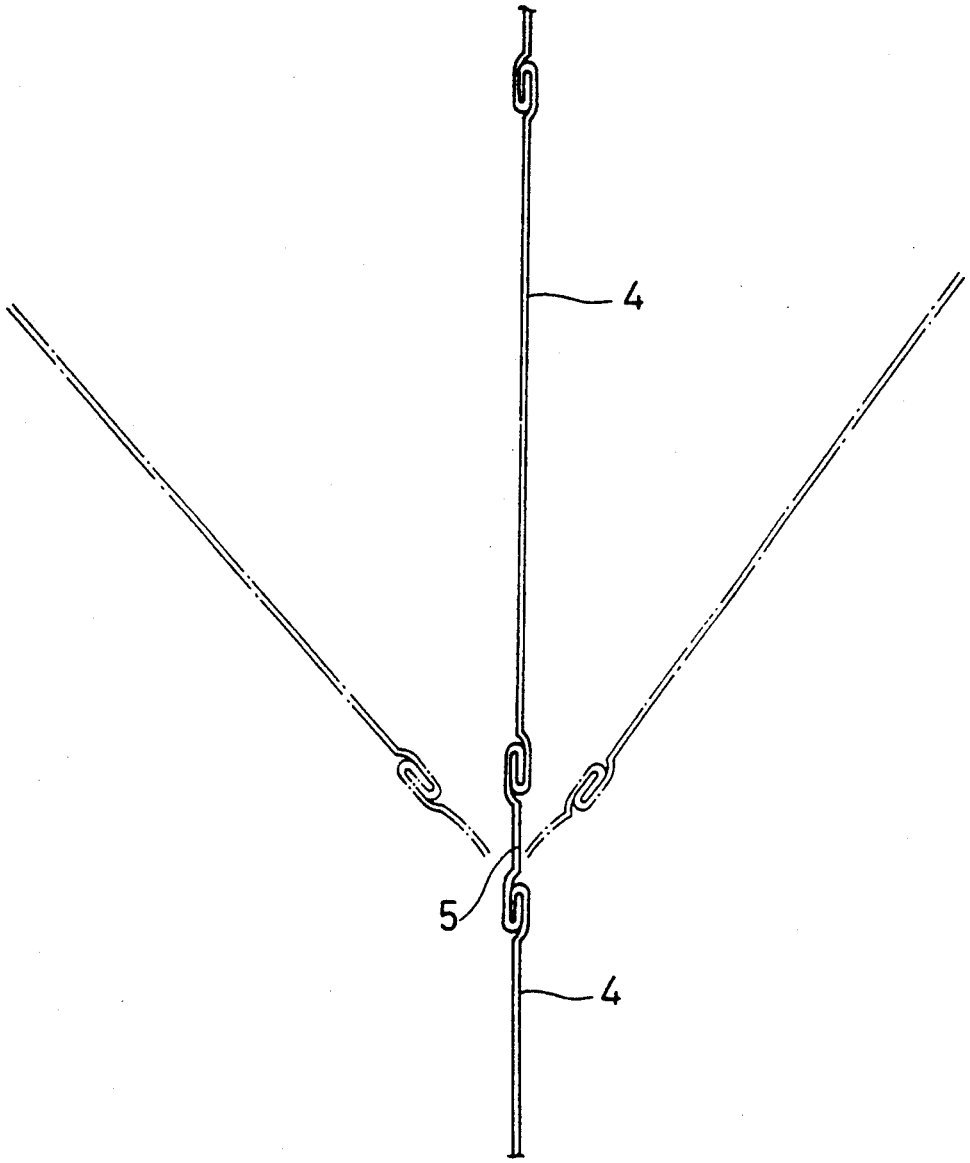
FIG. 3 illustrates the operation of the shutter curtain.

Preferred embodiments of the present invention will now be described with reference to the drawings. Referring to the drawings, reference numeral 1 represents a shutter curtain for an opening such as a window or door of a building, the shutter curtain 1 being wound to a take-up drum 2 fitted to a portion above an opening of a building. The shutter curtain 1 is arranged in such a manner that it is guided by guide rails 3 disposed on the two sides of the opening so that it is vertically moved to be raised/lowered.

The shutter curtain 1 is constituted in such a manner that main slats 4, each of which is made of a rigid material such as metal exemplified by steel, aluminum and the like or synthetic resin each of which is employed in a conventional shutter curtain, and sub-slats 5 made of a material having weak rigidity and elasticity such as spring steel, synthetic resin and the like, which are alternately connected.

That is, each of the main slats 4 and the sub-slats 5 is, according to this embodiment, arranged to be in the form of a flat plate. Their two end portions confronting each other are fastened to each other in a flat-lock seam state so that the main slats 4 and the sub-slats 5 are integrally connected to one another. The shutter curtain 1 thus formed in series can be wound to the take-up drum 2 in such a manner that the sub-slats 5 having weak rigidity are elastically deformed and curved.

According to this embodiment of the present invention constituted as described above, the building opening is opened/shut by moving upwards/downwards the shutter curtain 1 which is guided by the guide rails 3. According to the shutter curtain thus-formed, the presence of undesirable gaps in the junction portions between connected slats are eliminated, the gaps being involved in the conventional structure whereby the rigid slats are connected utilizing an interlocking means such that the rigid slats can be folded. As a result, the generation of noise due to collisions of the slats or when the shutter is being raised/lowered or when exposed to the wind can be eliminated. Therefore, a silent building opening shutter exhibiting low noise can be constituted. Furthermore, since the gaps can be eliminated from the junctions between the slats, the shutter curtain according to this embodiment possesses additional advantages in terms of preventing fire, stopping smoke and insulating sound.

In addition, the shutter curtain according to this embodiment is wound to the take-up drum 2 in such a manner that the sub-slats 5 having elasticity and flexibility are bent instead of the main slats 4. Therefore, it can be smoothly wound to form a coil-like shape similar to conventional structures having the interlocking connections.

Furthermore, since the shutter curtain according to this embodiment can be bent and is adaptable to both the forward winding structure and the reverse winding structure, it can be used in a manner similar to the conventional interlocked type shutter curtain. Therefore, no problem will arise with the shutter curtain according to this embodiment.

The present invention is not limited to the above-described embodiment if the structure is arranged in such a manner that the slats possessing strong rigidity, that is, the main slats, and slats possessing weak rigidity but possessing elasticity, that is, the sub-slats, are used in series to form the shutter curtain. Therefore, other structures shown below may be employed.

Figure 4A:
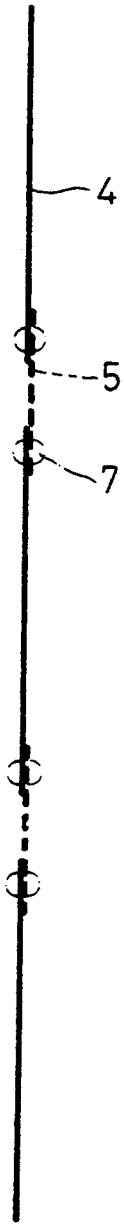
FIGS. 4A to 4S are pattern drawings which illustrate a variety of embodiments of the shutter curtain.
Figure 4B:
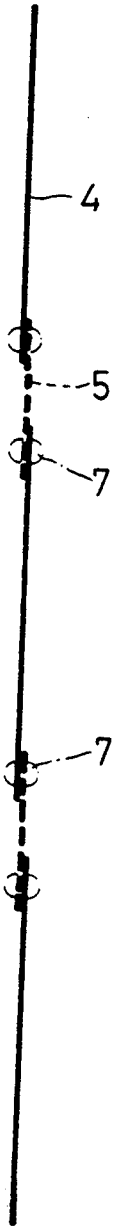
Figure 4C:
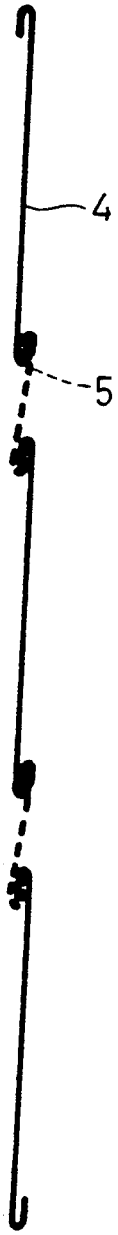
Figure 4D:
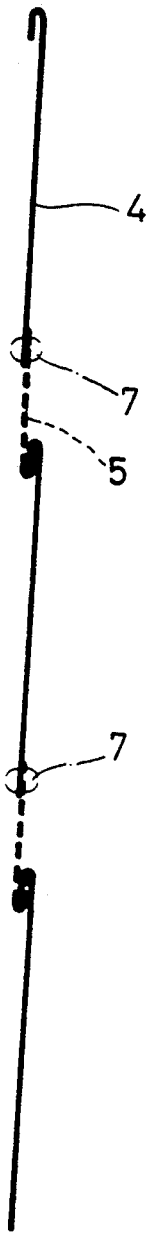
Figure 4E:
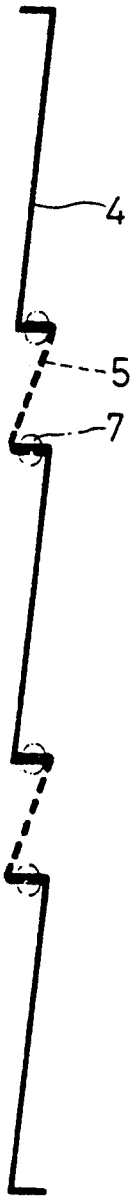
Figure 4F:
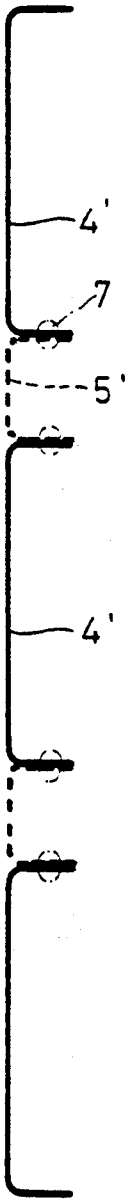
Figure 4G:
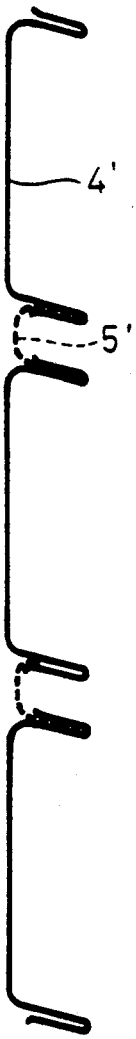
Figure 4H:
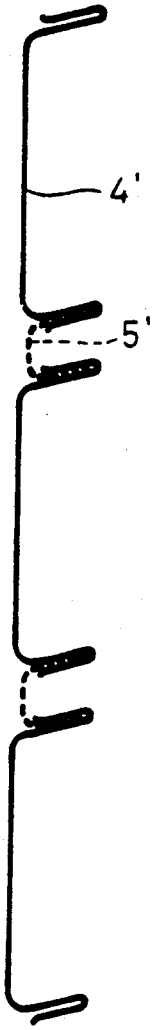
Figure 4I:
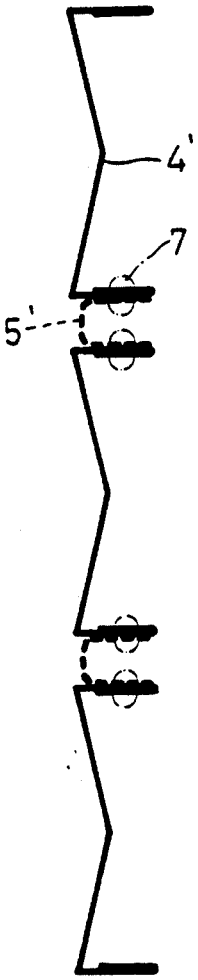
Figure 4J:
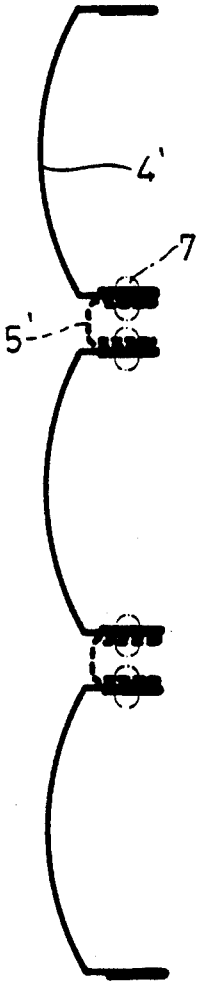
Figure 4K:
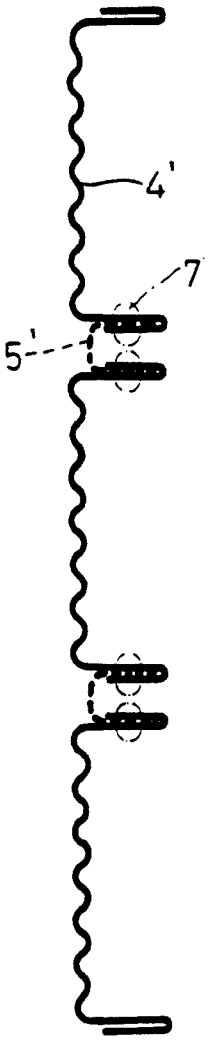
Figure 4L:
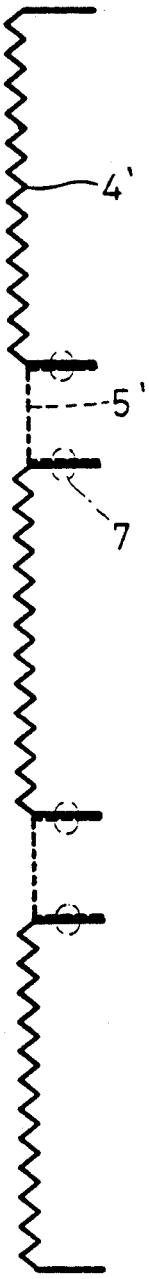
Figure 4M:
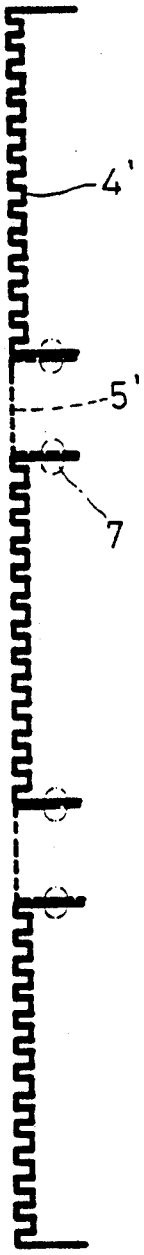
Figure 4N:
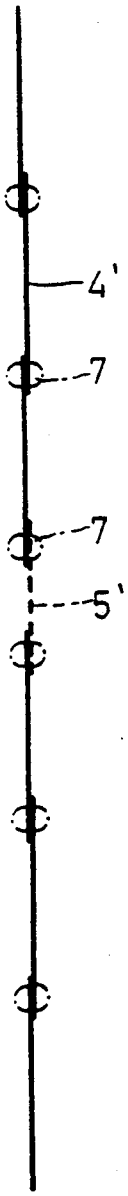
Figure 4O:
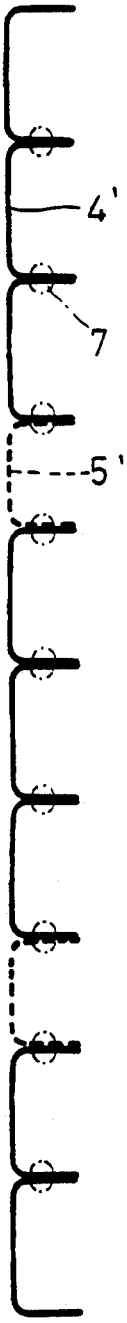
Figure 4:
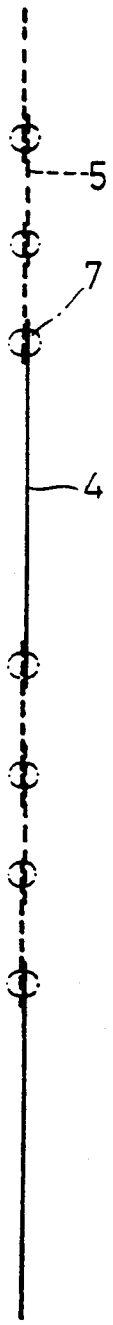
Figure 4:
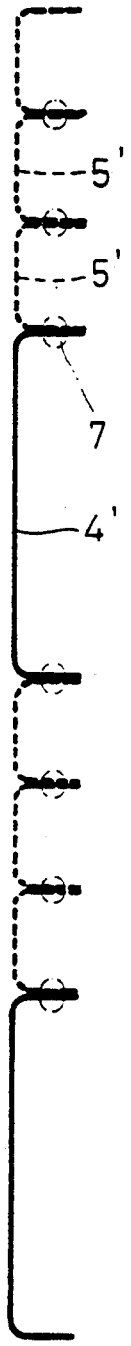
Figure 4:
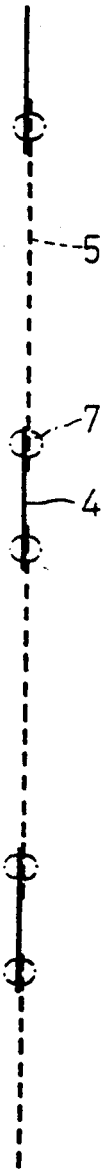
Figure 4:
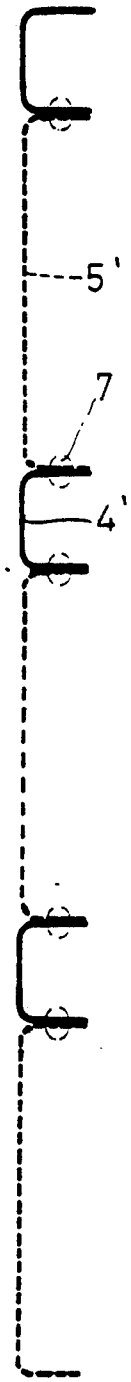
Figure 5A:
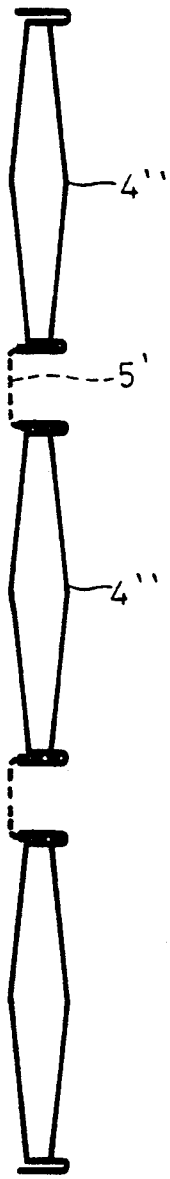
FIGS. 5A to 5J are pattern drawings which illustrate other embodiments of the shutter curtain.
Figure 5B:
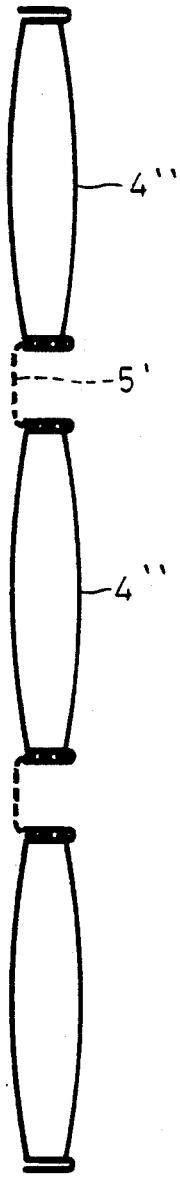
Figure 5C:
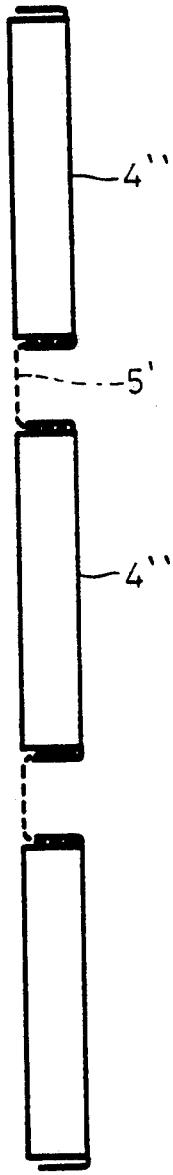
Figure 5D:
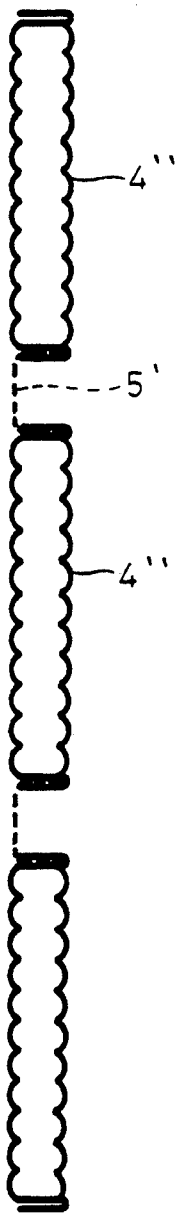
Figure 5E:
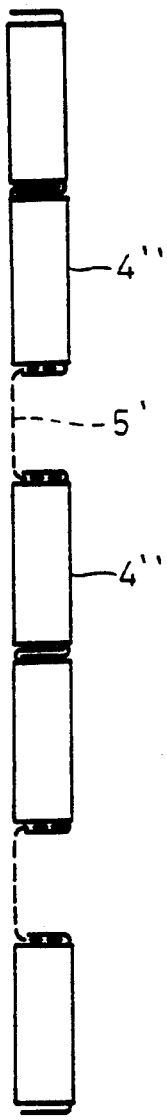
Figures 5F, 5G, 5H, 5I, 5J:
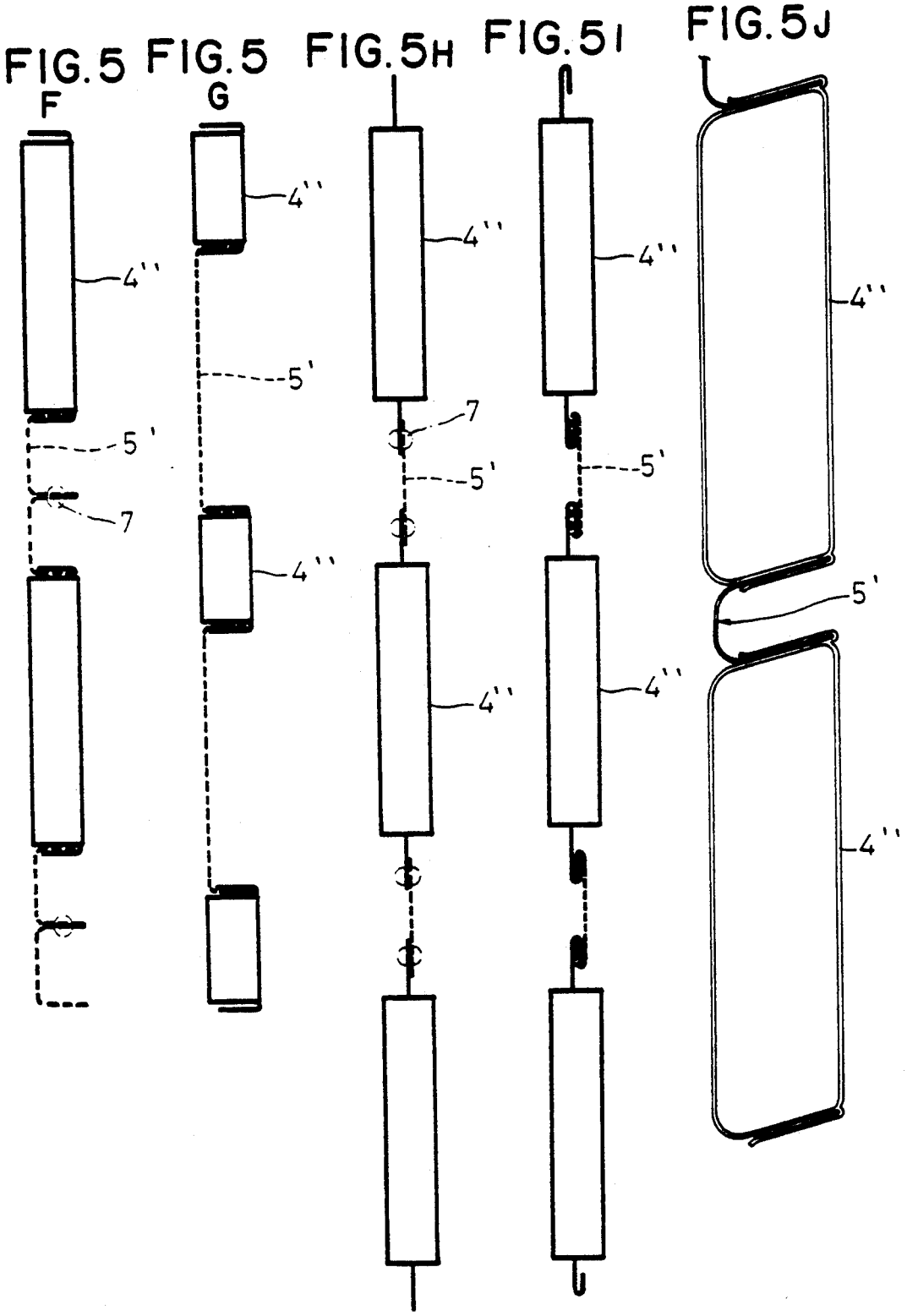
Figure 6:
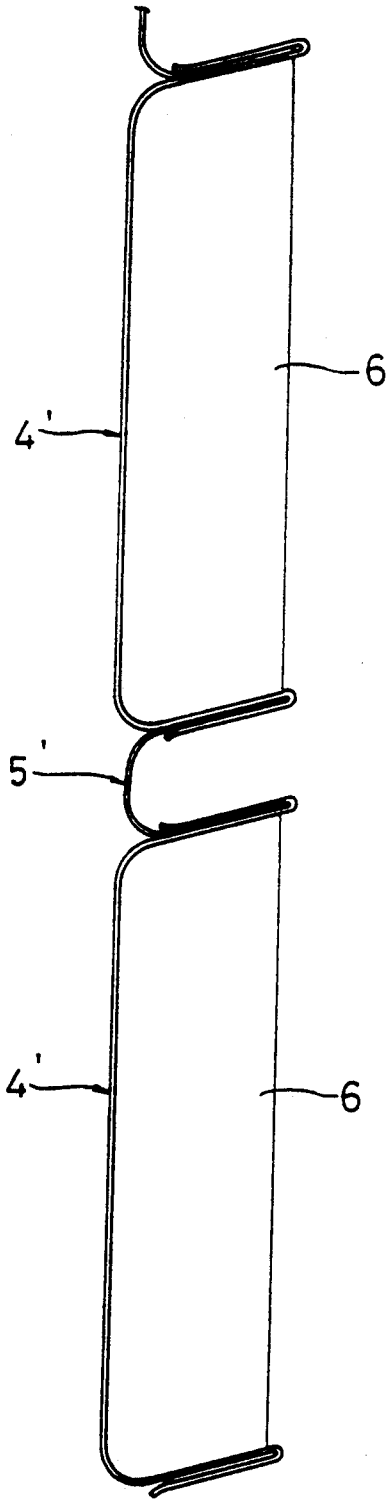
FIGS. 6A to 6D are pattern drawings which illustrate other embodiments of the shutter curtain.
Figure 6:
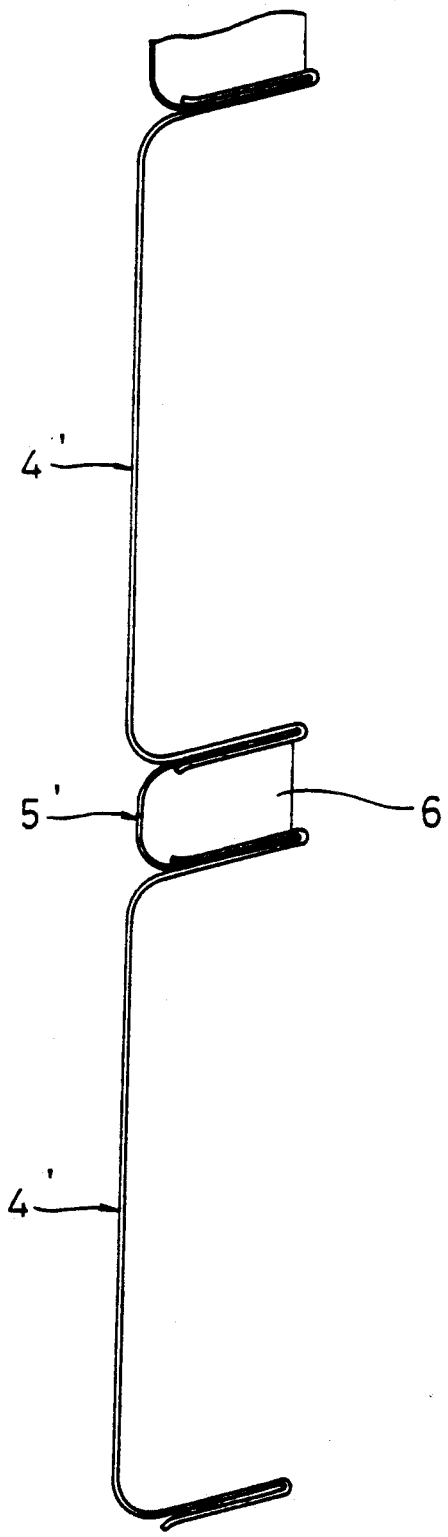
Figure 6:
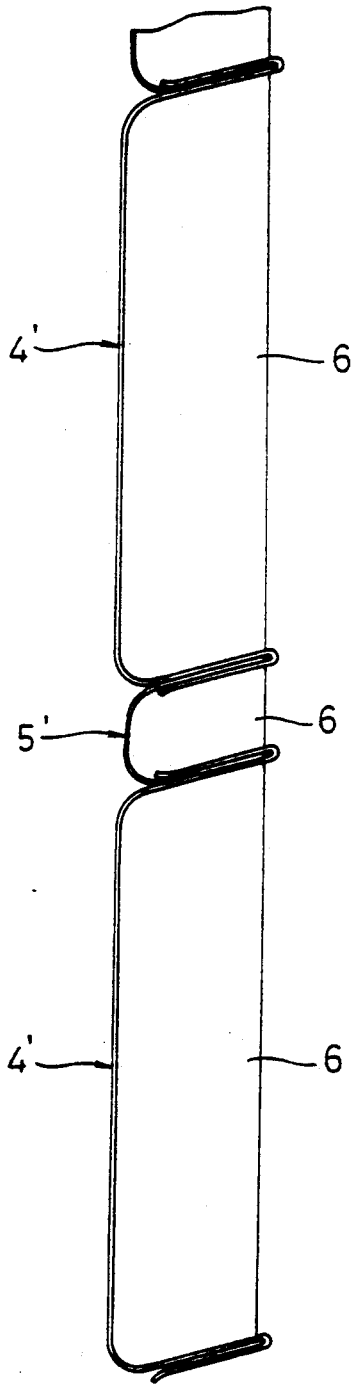
Figure 6:
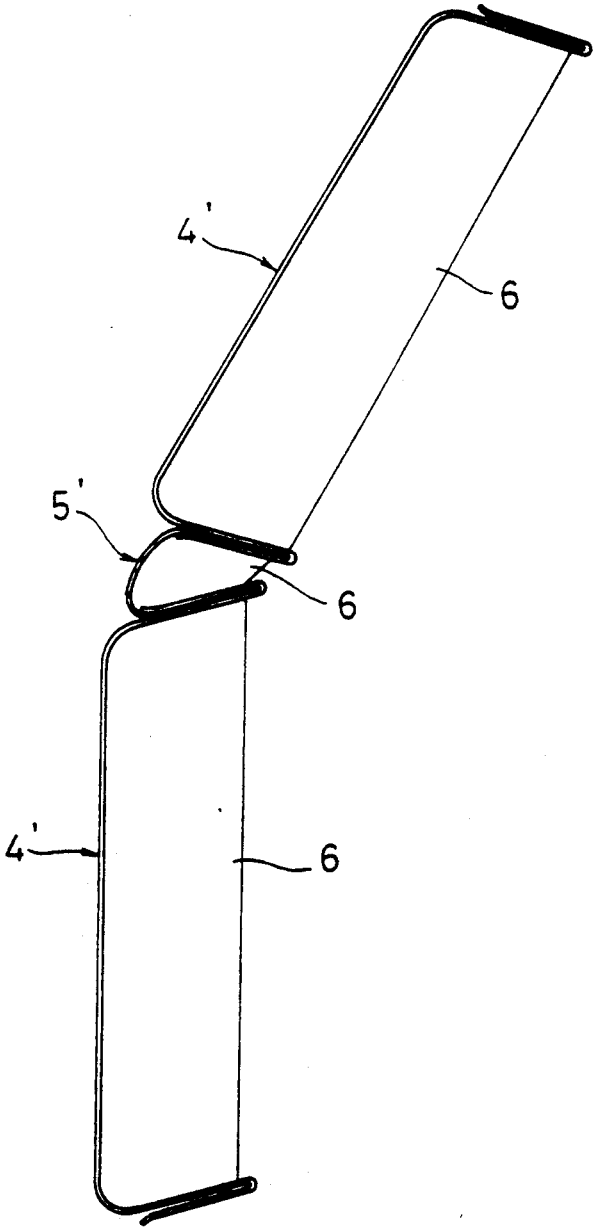
Figure 7:
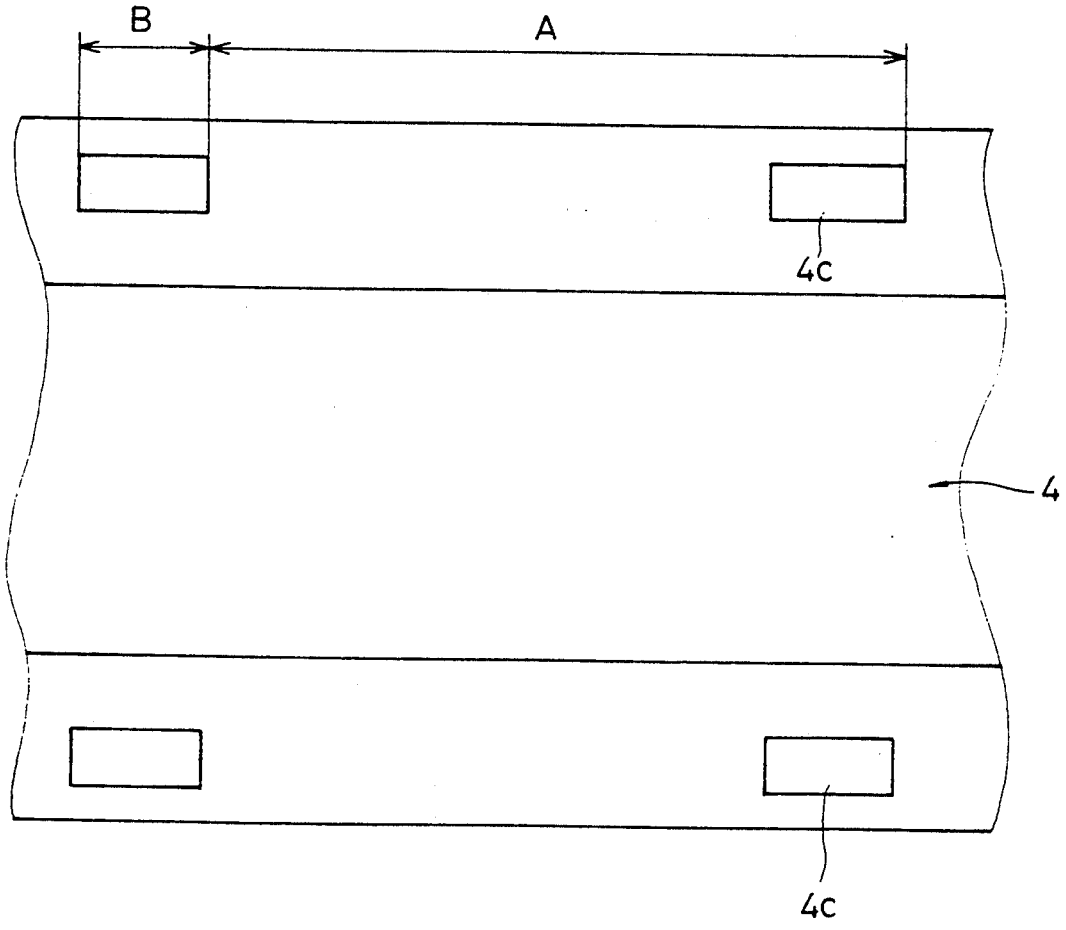
FIGS. 7A and 7B respectively are a front illustrate a main slat.
FIGS. 7C and 7D respectively are a front elevational view and a side cross sectional view which illustrate a sub-slat.
FIG. 7E is a side cross sectional view which illustrates a state where the slats are connected.
Figure 7:
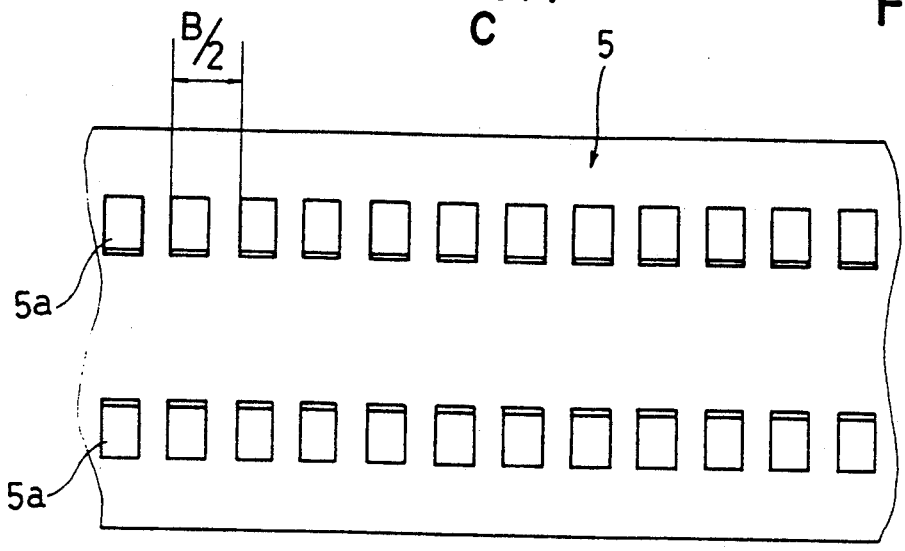
Figure 7:
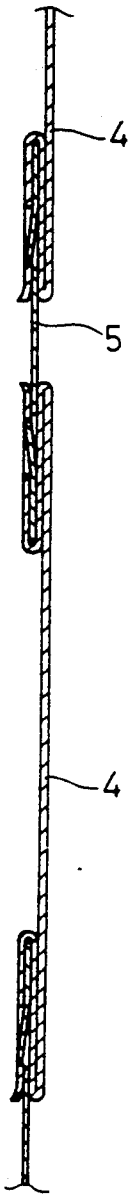
Figure 7:
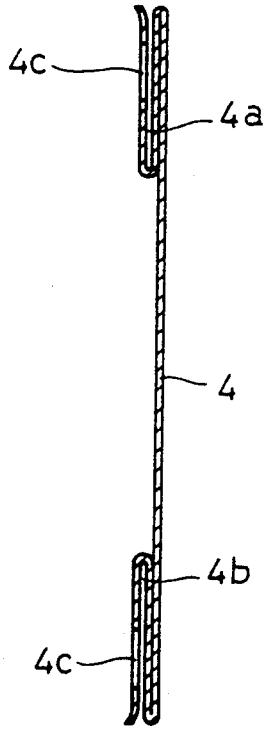
Figure 7:
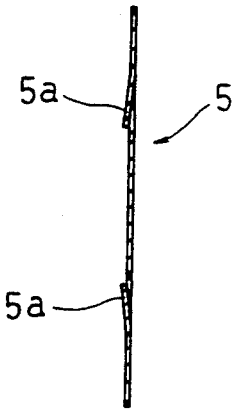

That is, the shutter curtain may be structured according to embodiments the pattern of each is shown in FIGS. 4 to 6. Referring to each of these pattern drawings, continuous lines show the rigid main slats and dashed lines show the elastic sub-slats. Referring to FIG. 4, embodiments are respectively arranged in such a manner that both the main slats 4 and the sub-slats 5 are in the form of flat plates (see FIGS. 4A to 4D). Another structure is shown in which the main slats and/or the sub-slats are in the form of a Z-like-shape (see FIG. 4E). Another structure is shown which is arranged in such a manner that the main slats 4' and/or the sub-slats 5' are in the form of a U-like-shape facing side (FIGS. 4F to 4H). Other structures, modifications to the U-shape facing side, are shown and arranged in such a manner that the main slats and/or the sub-slats are respectively in the form of a figure-Σ-like shape, semicircular-like shape, waveform-like shape, zigzag shape and projections/recesses (see FIGS. 4I to 4M). Furthermore, another structure is arranged in such a manner that a plurality of the main slats 4, 4' or the sub-slats 5, 5' are connected in series (see FIGS. 4N to 4Q). In addition, a structure is shown in which the sub-slats 5, 5' are arranged to be longer than the main slats 4, 4' (see FIGS. 4R and 4S).

Furthermore, a structure in which each of the main slats 4'' is arranged to be in the form of a hollow shape (see FIGS. 5A to J), may be employed.

In addition, as shown in FIG. 6, the shutter curtain having the recesses because the slats 4', 5' are in the form of the U-shape facing side and the hollow type shutter curtains having hollow portions may be arranged in such a manner that these recesses or hollow portions are filled with heat insulating materials 6. In this case, numerous structures can be adapted to meet a particular desire from a group that includes a structure in which the recessed portions of the main slats are filled with the heat insulating materials 6 (see FIG. 6A), a structure in which the recessed portions of the sub-slats are filled with the heat insulating materials 6 (FIG. 6B) and a structure in which the recessed portions of the main slats 4' and the sub-slats 5' are filled with the heat insulating materials 6 (see FIG. 6C). In a case where the sub-slats are filled with the heat insulating materials, it is preferable that the heat insulating material be an elastomeric material in consideration of the fact that the sub-slats are bent as shown in FIG. 6D. The heat insulating material may, of course, be selected from foamed or non-foamed synthetic resin materials exemplified by a polyurethane resin material (any one of a hard material, a semi-hard material and a soft material), a denaturated polyisocyanurate resin material exhibiting excellent heat insulating characteristics, a polyethylene resin material, a polystylene resin material, a urea resin material, a phenol resin material and a polyvinyl chloride resin material. Furthermore, the following heat insulating materials may be employed solely or in a properly combined manner: various rubber materials possessing elasticity such as natural rubber and synthetic rubber; various inorganic heat insulating materials such as glass wool, rock wool, calcium silicate, perlite and vacuumlite; natural heat insulating materials such as cork; and brick materials such as heat insulating brick. The heat insulating material may be fastened to the slats by utilizing the adhesive strength of the material such as the polyurethane resin material which is exhibited during its chemical reaction, if the strength can be utilized. In addition, one or a plurality of known methods shown below can be selected to be adapted to the selected heat insulating material: adhesion, pasting, welding, fastening, and securing by using proper fixing members such bolts, pins, screws, rivets or the like.

As a means for directly connecting the adjacent slats, a variety of known connecting methods exemplified below may be employed: a method in which rivets 7 are used (see FIGS. 4A, 4B, 4D to 4F, 4I to 4S, FIGS. 5F and 5H); and a method in which they are connected by a flatlock-seam method. The structures in which the slats are in the form of the flat shape and a structure in which the same are in the form of the Z-shape may be arranged in such a manner that slats are connected in a louver manner (see FIGS. 4B, 4C, 4D and 4E), resulting in excellent weathering characteristics. The structures, in which the rivets are employed to fix the slats, may, as shown in FIGS. 4I, 4J and 4K, be arranged in such a manner that the two confront connection sides of the slats that are folded and overlapped for the purpose of improving the strength.

In a case where the main and sub-slats are in the form of flat plates, a connecting structure according to an embodiment shown in FIGS. 7A–E may be employed. That is, holding groove portions **4*a* and 4*b* are integrally formed in the two end portions of each of the main slats 4, the holding groove portions 4*a* and 4*b* respectively having openings which confront the adjacent sub-slats 5**.

Then, the end portions of the sub-slats 5 are inserted and fastened to the holding groove portions **4*a* and 4*b* thusformed so that the shutter curtain 1, in which the slats 4 and 5 are connected in series, can be constituted. In this structure, a mechanism for stopping the sub-slats 5 structured as follows may be employed: fastening holes 4*c* are formed in the holding groove portions 4*a* and 4*b* at a pitch A in their portion facing the inside portion of the building, each of the fastening holes 4*c* having a lateral length of B (the length measured in a direction in which the pitch A is measured). On the other hand, the sub-slat 5 has fastening members 5*a* formed by embossing in the two end portions thereof, the fastening member 5*a* having a pitch which is substantially half (B/2) the length of the fastening hole 4*c***.

As shown in FIG. 7E, the lower end portion of the sub-slat 5 is forcibly inserted into the lower holding groove portion **4*a* and the upper end portion of the sub-slat 5 is similarly inserted into the lower holding groove portion 4*b* in such a manner that the fastening members 5*a* are fastened to the corresponding fastening holes 4*c*. As a result, the main slats 4 and the sub-slats 5 can be connected in series while assuredly being stopped from separation. According to the structure thus constituted, the loads acting on the sub-slats 5, when the shutter curtain 1 has been perfectly lowered, can be made to act in the direction of the face plate in addition to the effect obtainable in that the main slats 4 and the subslats 5 can be easily connected. Therefore, the application of excessive load to the bent portions, which are involved when the structure is arranged in such a manner that the junctions between the main slats 4 and the subslats 5 are bent toward the inside of the building, can be prevented, resulting in an excellent advantage in terms of the structure obtained. Furthermore, since the junctions between the slats 4 and 5 are not exposed to the outside of the building, enhanced appearance can be realized. In addition, positive effects of crime prevention and corrosion prevention can be obtained. Furthermore, since the fastening members 5*a* are inserted and fastened into the fastening holes 4**, undesirable lateral displacement can be prevented. Therefore, another effect can be obtained in that the necessity of providing metal end stoppers involved in the conventional structure, in which the interlocking connection method is employed for the purpose of preventing the lateral deviation of the slats, can be eliminated.

Figure 8:
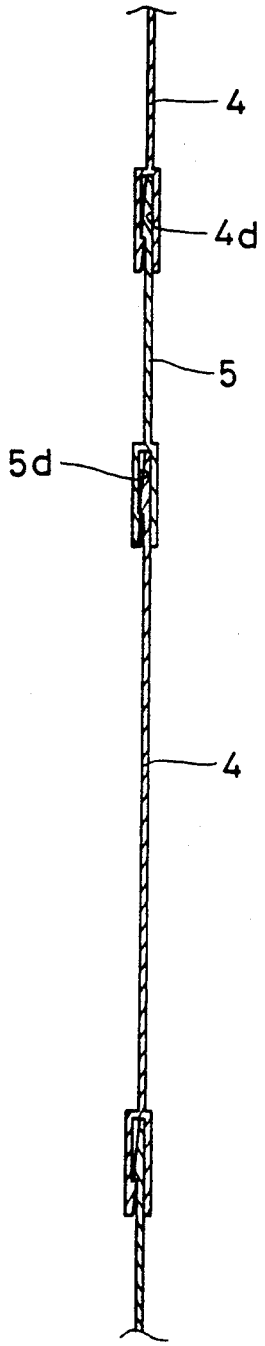
FIGS. 8A to 8C are side cross sectional views which illustrate a variety of states in each of which the slats are connected.
Figure 8:
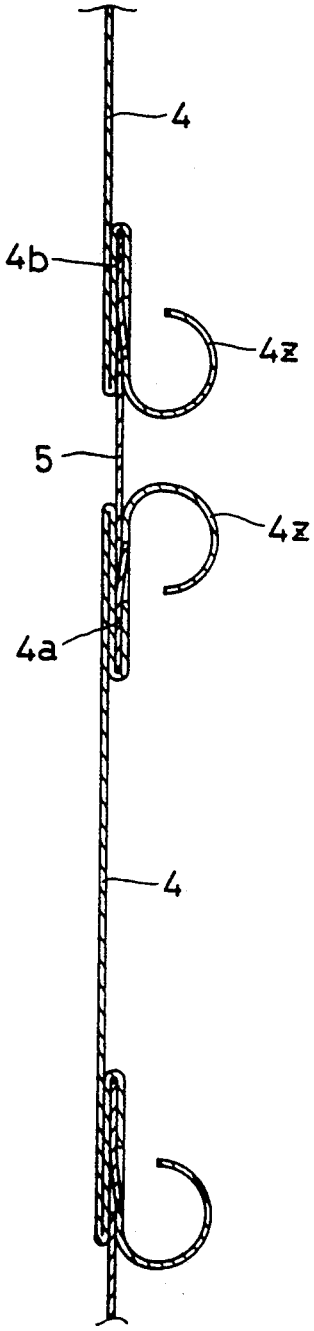
Figure 8:
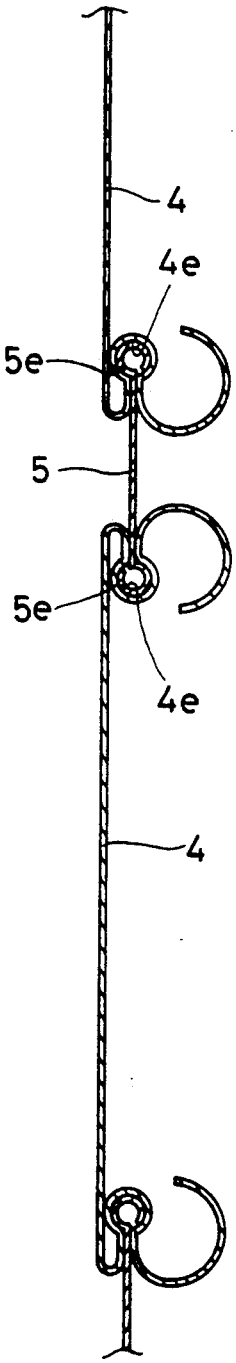
Figure 9A:
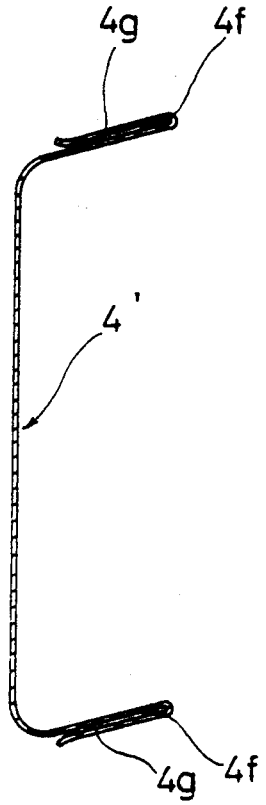
FIGS. 9A and 9B respectively are a side cross sectional view and a top elevational view which illustrate the main slat in the form of a U-like-shape.
Figure 9C:
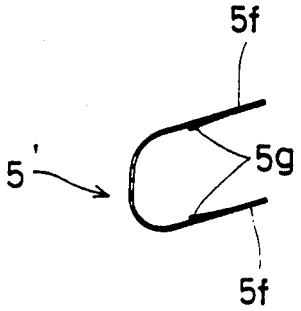
FIGS. 9C and 9D respectively are a side cross sectional view and a top elevational view which illustrate the sub-slat in the form of the above-described shape.
Figure 9B:
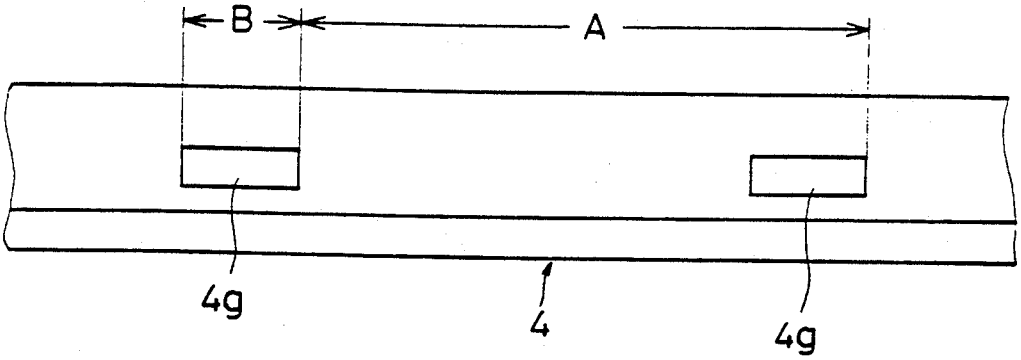
Figure 9D:
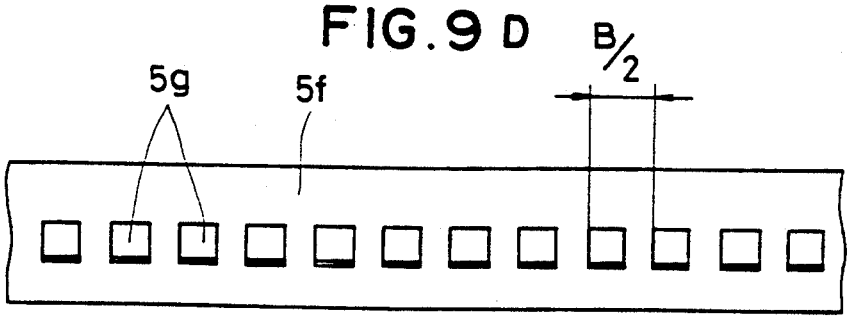
Figure 9E:
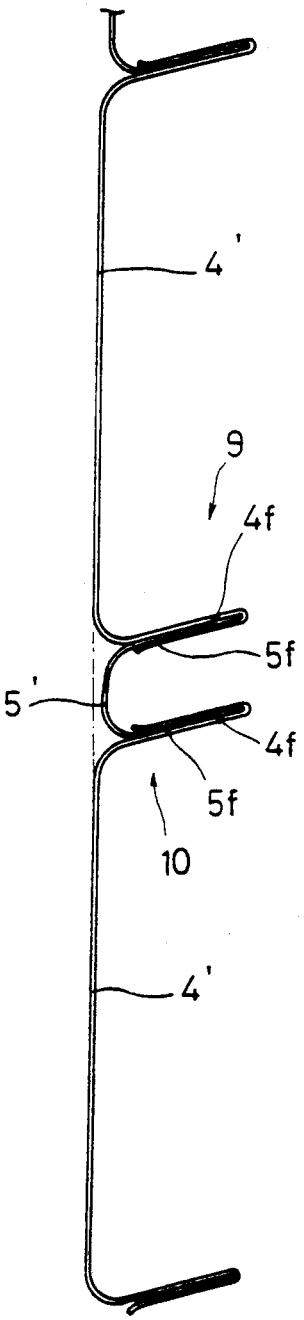
FIG. 9E ,is a side elevational view which illustrates a state where the slats in the form of the above-described shape are connected.
Figure 9F:
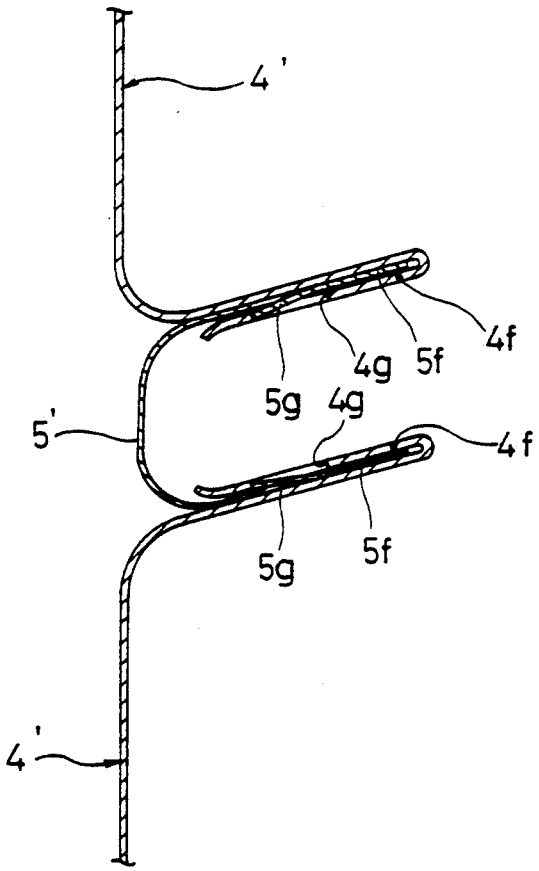
FIG. 9F is an enlarged cross sectional view which illustrates the junction.

Furthermore, as the means for connecting the flat slats, structures respectively shown in FIGS. 8A, 8B and 8C may be employed. That is, an embodiment shown in FIG. 8A may be structured in which holding grooves **4*d* and 5*d* having downward openings are formed in the corresponding lower end portions of the main slats 4 and the sub-slats 5. The upper end portions of the adjacent slats 4 and 5 are inserted into the holding grooves 4*d* and 5*d* thus-formed. In the above-described case, it is convenient to form fastening claw mechanisms in order to prevent the separation of the slats 4 and 5**.

Furthermore, embodiments shown in FIGS. 8B and 8C may be employed in which curved portions **4*z* are extended toward the inside of the building from the holding grooves 4*a* and 4*b* so as to increase the thickness of the slats 4 and 5. As a result, an advantage can be realized in that the contact between the overlapped slats, which takes place when the shutter curtain is wound to the take-up drum 2, can be prevented as desired. FIG. 8C illustrates another embodiment in which holding grooves 4*e* are formed in the two end portions of the main slats 4, the holding groove 4*e* having a shape expanding toward the end portion thereof. Furthermore, fastening portions 5*e* in the form of longitudinal edge ribs are formed in the two end portions of the sub-slats 5. The fastening portions 5*e* are longitudinally slid into the holding grooves 4*e* of the main slats 4 to prevent the separation of the slats 4 and 5**. This structure may, of course, be employed.

A structure in which the main and the sub-slats 4' and 5' are in the form U-like-shape may employ the following connecting means as a structure in which no rivet is used (see FIGS. 9A–F). That is, the two end portions of the main slat 4' have holding groove portions **4*f* which project toward the inside portion of the building and which have openings facing outside. Furthermore, fastening holes 4*g* are formed in the holding groove portions 4*f*. In addition, the two end portions of the sub-slat 5' have fastening portions 5*f* projecting toward the inside portion of the building, the fastening portions respectively having fastening tongues 5*g*. The fastening portions 5*f* of the sub-slat 5' are inserted into the holding groove portions 4*f* of the main slat 4' in such a manner that the fastening tongues 5*g* are fitted within the fastening holes 4*g* so that the main slats 4' and the sub-slats 5' are connected. The size and positional relationship between the arranged elements are established similarly to those according to the embodiment shown in FIG. 7**. As a result, the slats each of which is in the form of a U-like-shape can easily be connected while preventing separation of the same from each other.

Figure 10A:
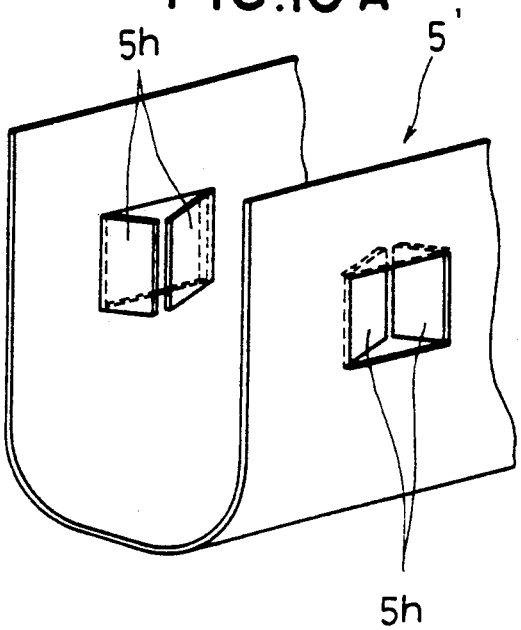
FIGS. 10A to 10E are perspective views which illustrate an essential portion of an example of fastening members formed in the sub-slats.
Figure 10B:
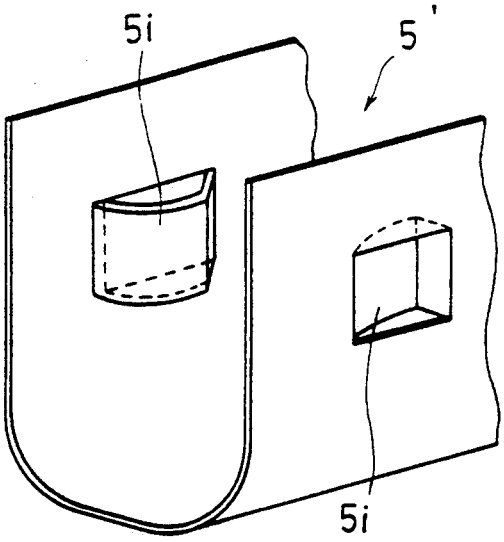
Figure 10C:
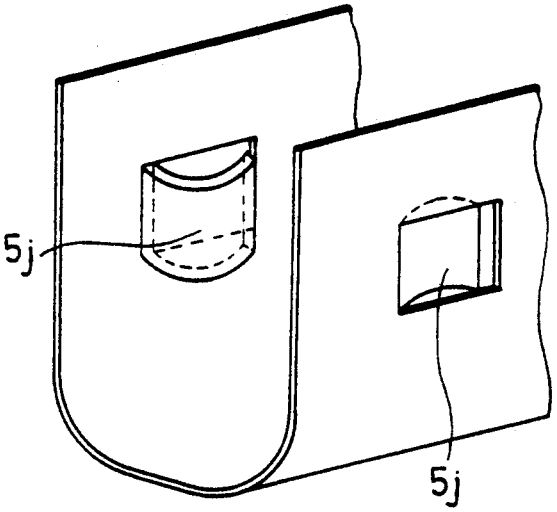
Figure 10D:
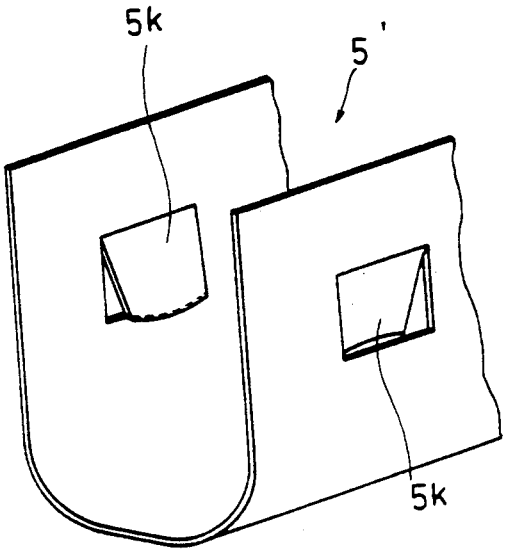
Figure 10E:
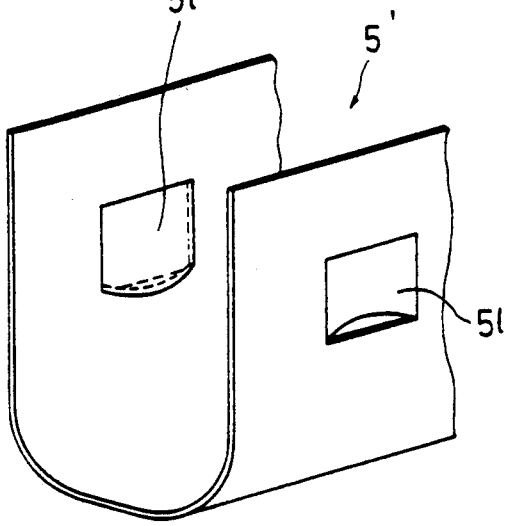

Another structure may be employed in which such fastening holes and fastening portions are formed for the purpose of connecting them while preventing the separation. That is, the embodiment shown in FIG. 10A is arranged in such a manner that the shape of a fastening member **5*h* formed in the sub-slat 5' is constituted by a pair of confronting projecting elements formed by cutting in such a manner that an angle made by the confronting projecting elements is increased in a direction perpendicular to the lengthwise direction of the slat. Also in this case, the displacement of the slats in the lengthwise direction of the slat and as well as the separation of the slats can be assuredly prevented. Another embodiment arranged shown in FIG. 10B may be employed in which the two fastening portions 5*f* of the sub-slat 5' respectively have raised fastening members 5*i* which are formed by cutting and which are arranged in such a manner that either side (according to this embodiment, the left side when viewed in the drawing) of the fastening member 5*i* is moderately inclined and another side is steeply inclined. In this case, only the movement of the sub-slats 5 to the left with respect to the position of the main slat 4' is allowed after the slats 4' and 5' are connected. As a result, an advantage can be realized in that any one of the main slats 4' and the sub-slats 5 can be removed and exchanged, if necessary. An embodiment shown in FIG. 10C is arranged in such a manner that fastening members 5*j*, each of which has two side portions which are moderately expanded in the lengthwise direction of the sub-slat 5', are formed in the sub-slats 5'. According to this embodiment, the side movement of the sub-slats 5' in the lengthwise direction of the main slats 4' is allowed. Therefore, an advantage can be realized in that any of the main slats 4' and the sub-slats 5' can be removed and exchanged, if necessary. Furthermore, embodiments shown in FIGS. 10D and 10E are arranged in such a manner that fastening members 5*k* and 5*l* are formed which moderately expand in the three directions, that is, the two directions in the lengthwise direction of the sub-slat 5' and the direction into which the sub-slat 5' is forcibly inserted. Furthermore, only the portion of the sub-slat 5' opposite to its insertion portion into the holding groove portion 4*f* is expanded to form a step portion. As a result, only the lengthwise movement of the sub-slat 5' with respect to the position of the main slat 4'** is allowed.

Figure 11A:
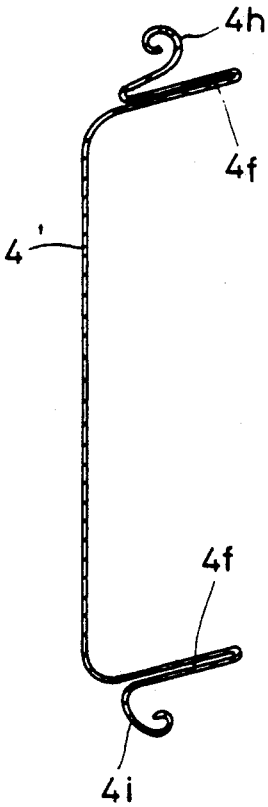
FIG. 11A is a side cross sectional view which illustrates a modified main slat.
Figure 11B:
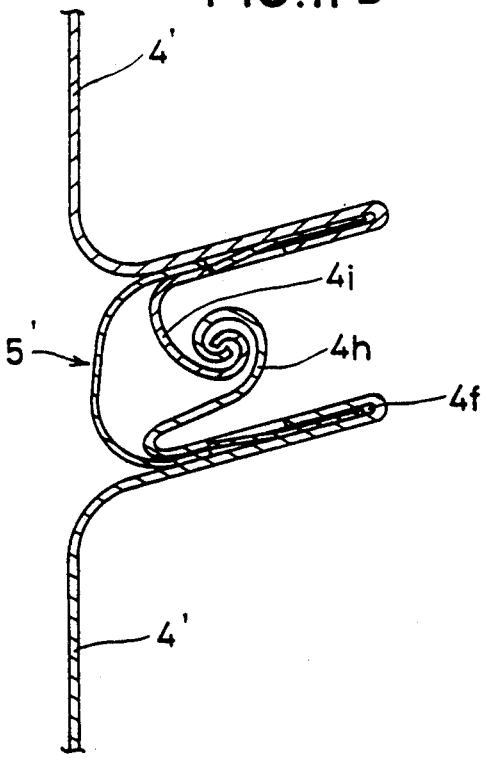
FIG. 11B is an enlarged cross sectional view which illustrates the junction for connecting the modified main slats.
Figure 11C:
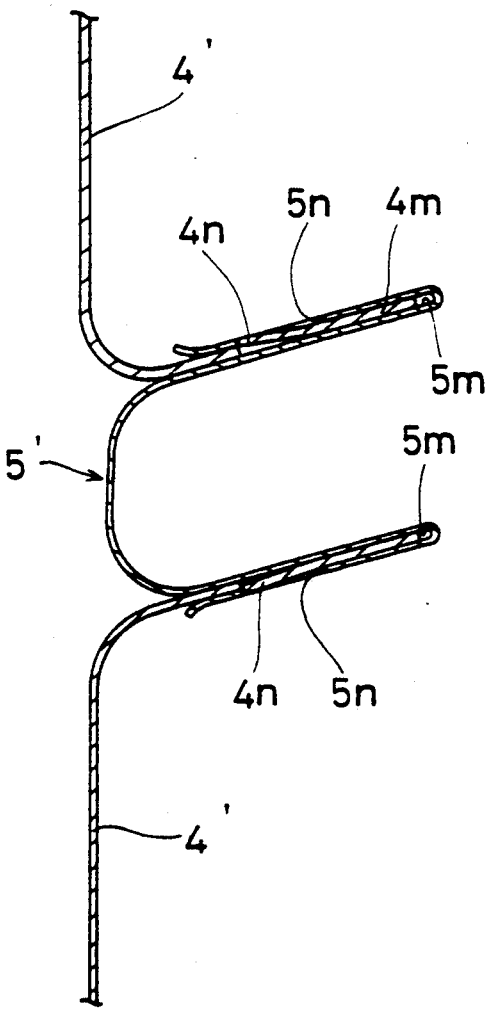
FIGS. 11C and 11D are enlarged cross sectional views which illustrate a variety of examples of the junction.
Figure 11D:
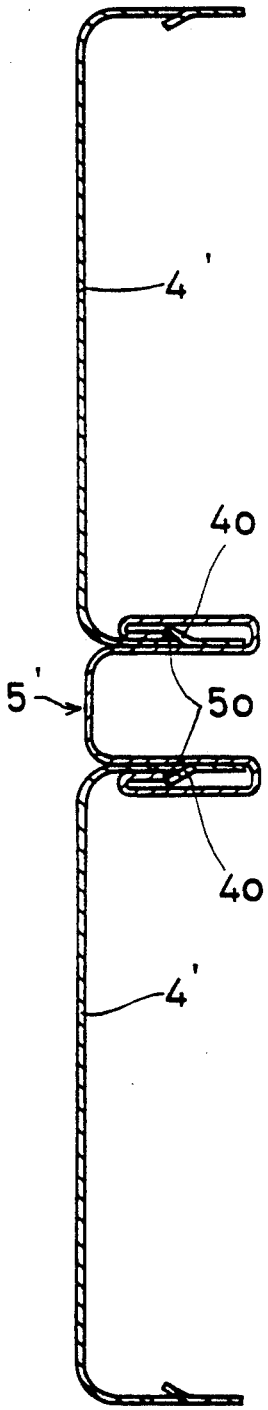

A developed connecting pattern shown in FIGS. 11A and 11B may be employed in which the holding groove portions **4*f*, which are arranged similarly to the above-described embodiments, are formed in the main slats 4'. Furthermore, the fastening members 4*h* and 4*i* extending to sufficiently reach the sub-slat 5' are formed in the two front portions of the main slats 4'. The adjacent fastening members 4*h* and 4*i* are fastened to each other by desirably bending them at the portion around the sub-slat 5' (interlocked). A structure may be employed in which the shutter curtain constituted as described above is arranged to have sub-slats which are made of an elastic material which possesses insufficient resistance against heat and cool. As a result, the problem of breakage and subsequent drop of the shutter curtain can be assuredly prevented by virtue of the interlocking of the fastening members 4*h* and 4*h* of the main slats 4' made of a rigid material even if the sub-slats 5' have been burnt off or broken down. Furthermore, another structure shown in FIG. 11C may be employed in which holding groove portions 5*m* having fastening holes 5*n* are formed in the sub-slats 5' and fastening portions 4*m* having fastening members 4*n* are provided for the main slats 4', so that they are connected in an inverted manner to that according to the above-described embodiments. In addition, another structure shown in FIG. 11D may be employed in which the end portions of the sub-slats 5' are further folded toward the inside portion of the building to form stepped front ends 5*o* to which raised fastening members 4*o* formed by cutting in the main slats 4'** are fastened.

Figure 12A:
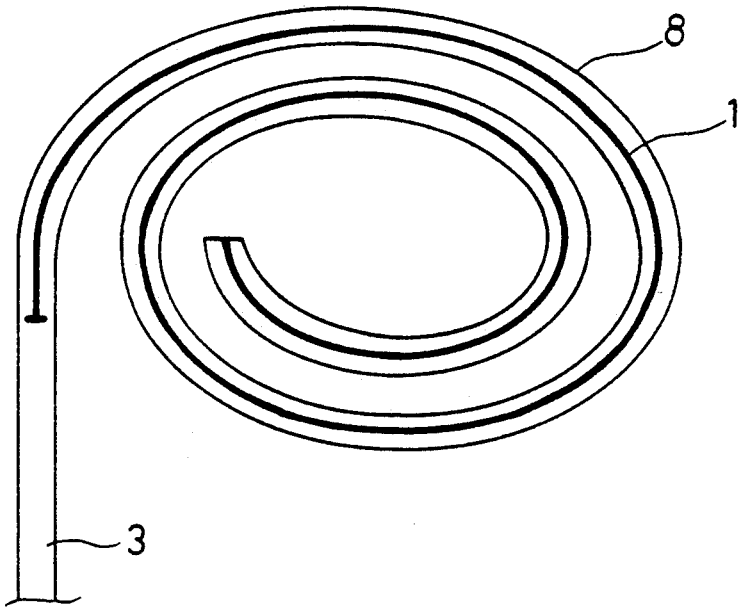
FIGS. 12A and 12B are pattern drawings which illustrate examples in which the shutter curtain is accommodated.
Figure 12B:
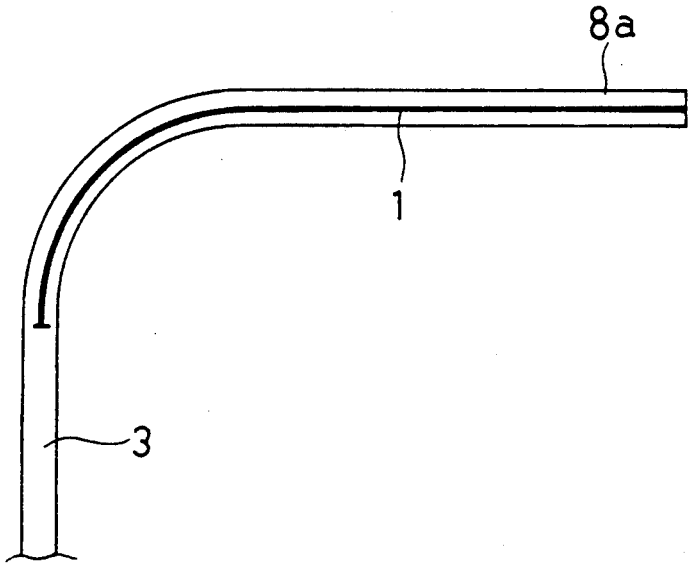

The shutter curtain 1 thus connected is usually wound to the take-up drum 2 to form a coil-like shape. It can be applied to a variety of accommodation methods such as a method shown in FIG. 12A and arranged in such a manner that the shutter curtain 1 is accommodated in a coil-like accommodating rail 8 and that shown in FIG. 12B in which the same is accommodated in a horizontal accommodating rail **8*a* from the guide rails 3** via curved rails. Furthermore, the direction in which the shutter curtain is moved is not limited to the vertical direction. The shutter curtain according to the present invention can be used in a lateral movement shutter, that is, so-called a horizontally-moving shutter.

Then, the winding of the shutter curtain 1 to the take-up drum 2 will now be described. The shutter curtain 1 having the slats 4' and 5' which are respectively in the form of U-like-shape is wound to the take-up drum 2 in a forward winding state, in which the U-shape opening side of the slats faces the take-up drum 2 (inside), and a reverse winding state, in which the same faces the opposite side (outside). The present invention can be employed regardless of the winding direction. Since the shutter curtain 1 is wound in the forward winding state, a preferred example in this case will now be described.

The description will be made about the shutter curtain arranged as shown in FIG. 9. That is, the shutter curtain 1 is constituted by connecting, in series, the main slats 4' made of the rigid material and the subslats made of the elastic material. The junctions (the portions in which the holding groove portions **4*f* and fastening portion 5*f* are fastened to each other) between the slats 4' and 5' respectively in the form of the U-shape are inclined in such a manner that their front portions (end portions in the inside portion of the building) face upward. Therefore, the portions of junctions 9 and 10** of the adjacent slats on the inside of the building are positioned relatively higher than the outside portions of the same. As a result, water, which flows downward along the outer surface of the shutter curtain, cannot be introduced into the junctions and therefore, can assuredly be prevented resulting in excellent weathering characteristics.

Figure 13A:
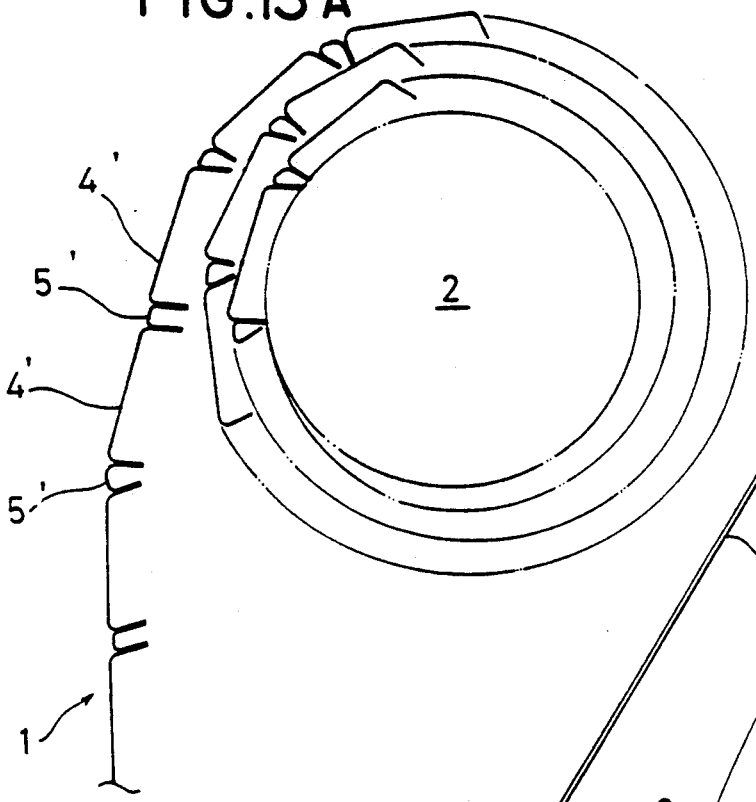
FIG. 13A is a schematic side elevational view which illustrates a state where the shutter curtain is being wound forward.
Figure 13B:
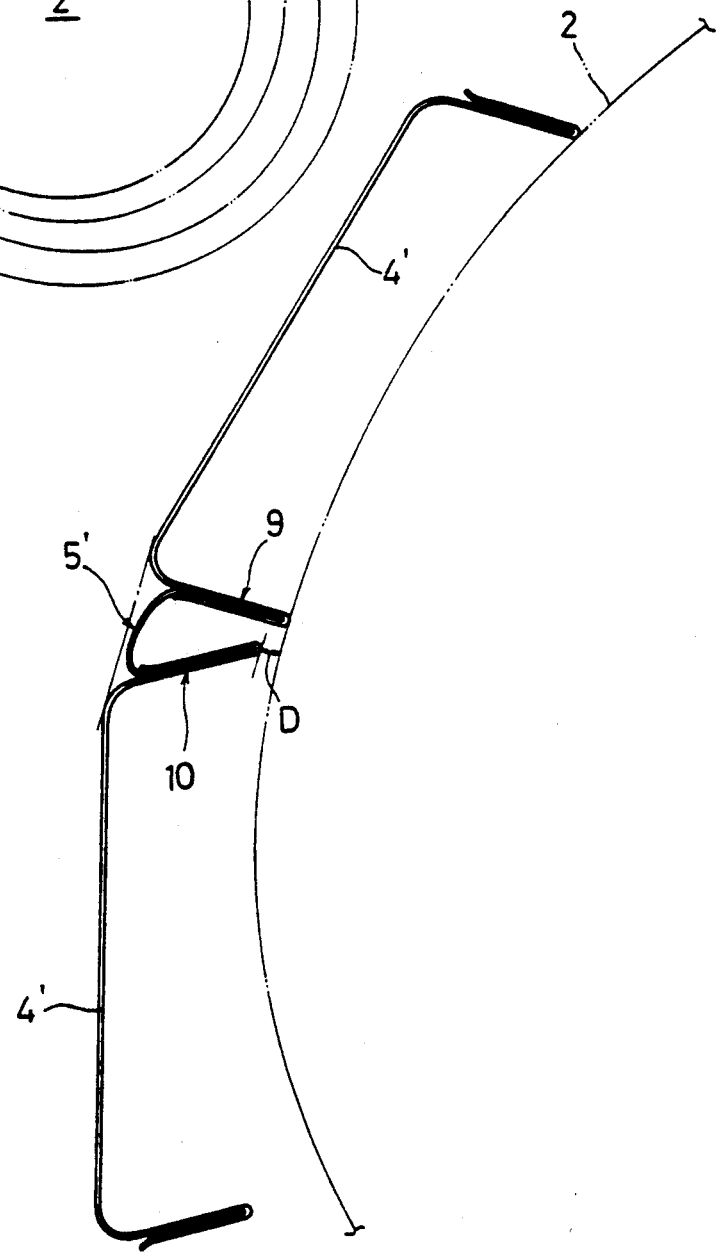
FIG. 13B is a partially enlarged view which illustrates this state.
Figure 14A:
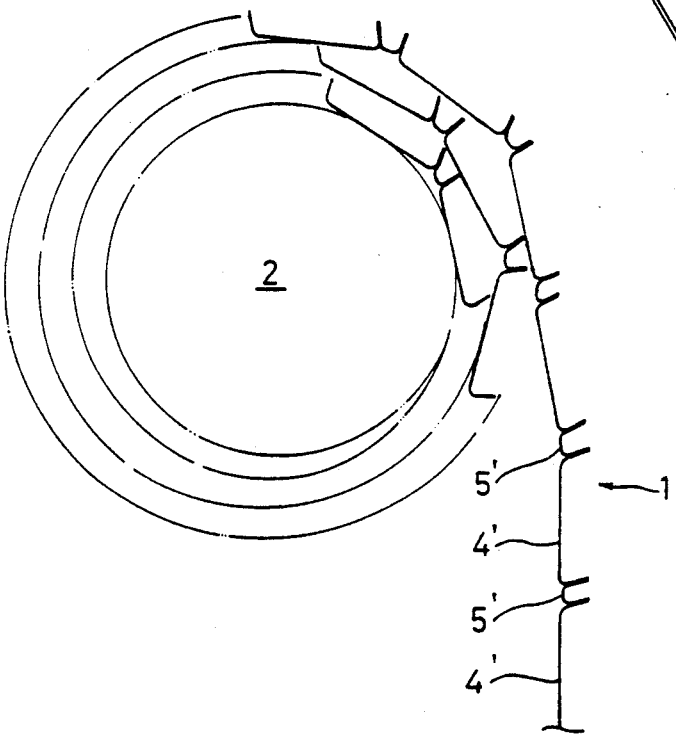
FIG. 14A is a schematic side elevational view which illustrates a state where the shutter curtain is wound reversely.
Figure 14B:
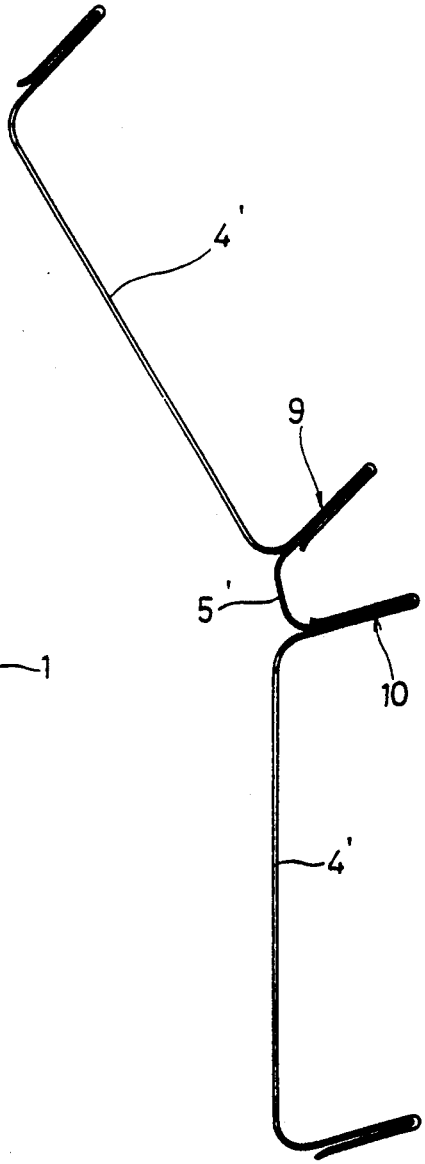
FIG. 14B is a partially enlarged view which illustrates the above-described state.

Furthermore, since the front ends (ends of the openings) of the holding grooves **4*f* formed in the main slats 4' are folded to expand outward, the fastening portions 5*f* of the sub-slats 5' can easily be fitted within the holding grooves 4*f*. In addition, in a case where the sub-slats 5' are, as shown in FIG. 13B, bent in the forward winding state, the sub-slats 5' are moderately curved while forming a large circular arc due to the guiding and supporting actions performed by the above-described expanded portion. Therefore, the sub-slats can be smoothly elastically deformed, obviating the problem whereby the front portions of the holding grooves 4*f*** having been steeply bent risk exceeding their elastic limit.

In addition, when the shutter curtain 1 is wound to the take-up drum 2 to form a coil, the junctions 9 and 10 of the adjacent slats 4' and 5' are positioned in such a manner that their inside portions are higher than the outer portions. Therefore, when the sub-slats 5' are warped so as to be wound to the take-up drum 2, the front portion of the lower junction 10 is, by a distance D, positioned further out than the front portion of the upper junction 9 with respect to the sub-slat 5', which is elastically deformed. As a result, when the shutter curtain 1 is wound, the sub-slats 5' are curved and deformed in a state where the front portions of the upper junctions 9, which are the leading portion when they are wound, are abutted and supported by the take-up drum 2 (or the shutter curtain 1 to which the shutter curtain 1 has been wound). At this time, the front portions of the rear junctions 10 are deformed in an idle state in which it does not substantially come in contact with the take-up drum 2 (or the shutter curtain to which the shutter curtain has been wound). Therefore, the potential problem arising when the front portions of the rear junctions 10 are rubbed by the take-up drum 2 or the shutter curtain 1 to which the shutter curtain 1 has been wound thereby damaging the slats 4' and 5' can assuredly be prevented.

Figure 15:
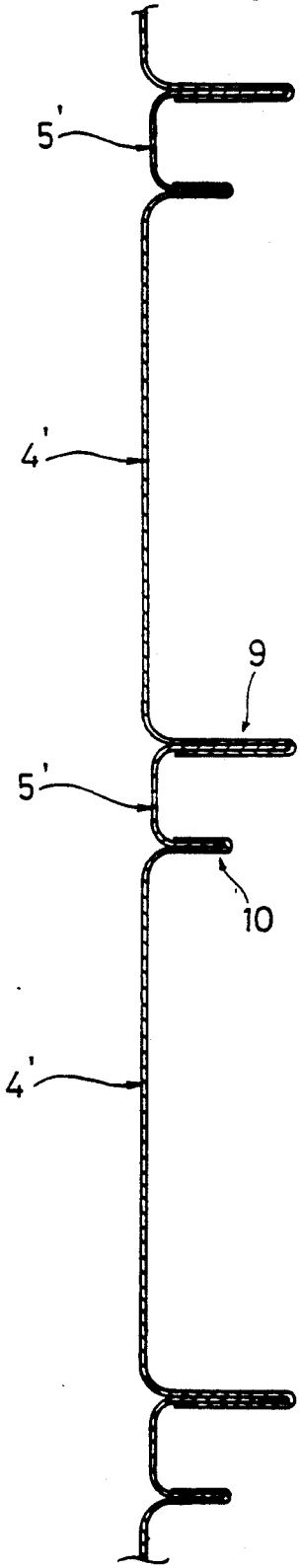
FIG. 15 is a side elevational cross sectional view which illustrates, another embodiment of the shutter curtain.

The structure, in which the front portion of the junction 9, which is the leading portion at the time of the winding operation, is projected toward the inside portion over the front portion of the junction 10, which is the ensuing portion at the time of the winding operation, can be realized, according to an embodiment shown in FIG. 15, by simply changing the relative length between the junctions 9 and 10.

Figure 16:
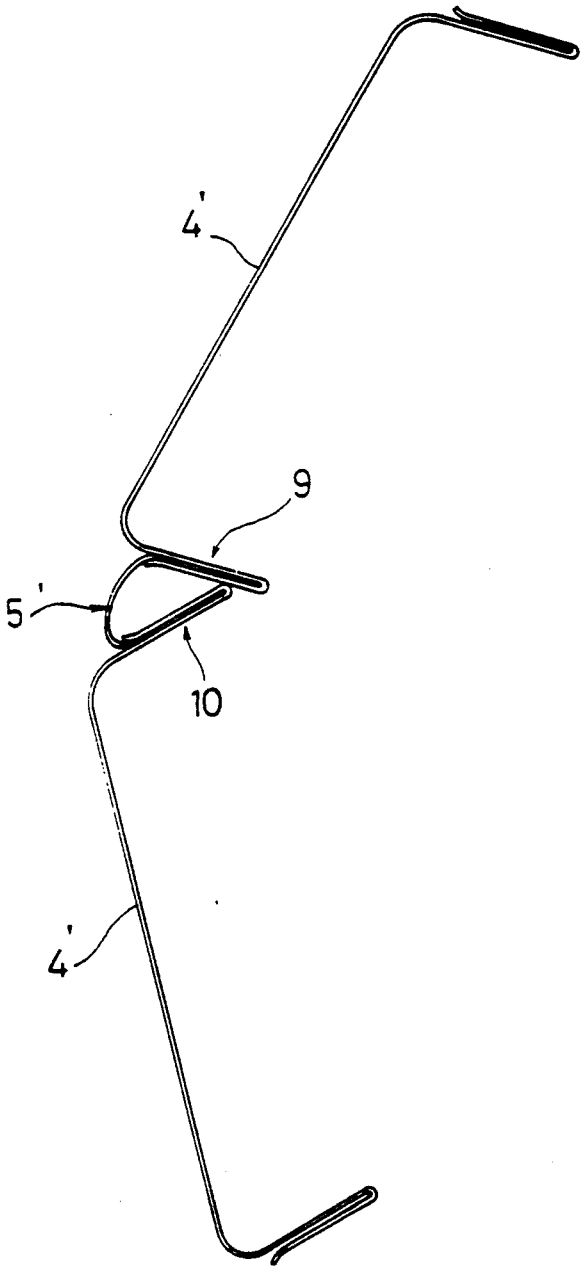
FIG. 16 is an operational view which illustrates a state where the shutter curtain is wound to form a coil-like shape having a small diameter.

The shutter curtain thus-manufactured is usually delivered from a manufacturing plant in such a manner that it is previously wound to the take-up drums 2. It is respectively individually wound to form coils, the diameter of each of which is made to be as small as possible before they are wound to the winding drums 2. This is because the volume of the coil must be reduced so as to save the accommodating space and facilitates handling and installation. In order to achieve this, the two junctions 9 and 10 across the sub-slat 5' (see FIG. 16), which is elastically deformed, are positioned in contact with each other ensuring that their elastic deformation is well below the elasticity limit so as to prevent the further elastic deformation of the sub-slat 5'. As a result, when the shutter curtain is handled solely in the manufacturing plant or the installing field, the two junctions 9 and 10 across the sub-slat 5' come in contact with each other before the sub-slat 5' is curved over its elastic limit. As a result, the sub-slat 5' can be assuredly protected from the damage.

Figure 17A:
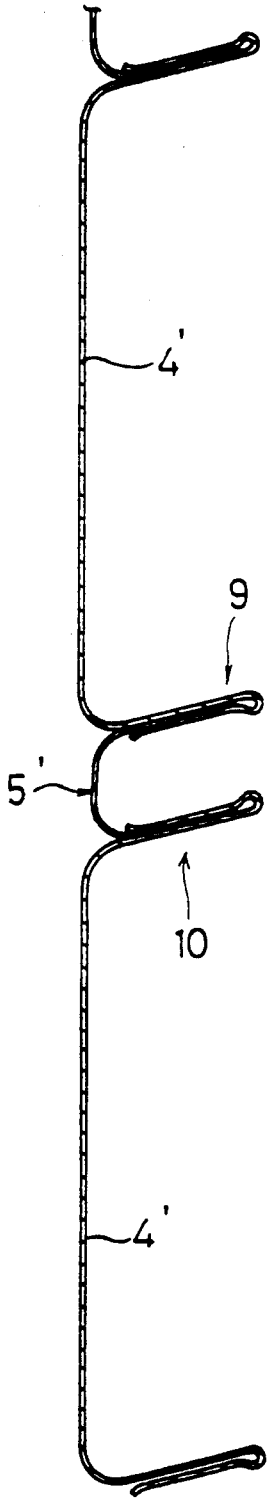
FIGS. 17A to 17D are enlarged cross sectional views which illustrate a variety of junctions.
Figure 17B:
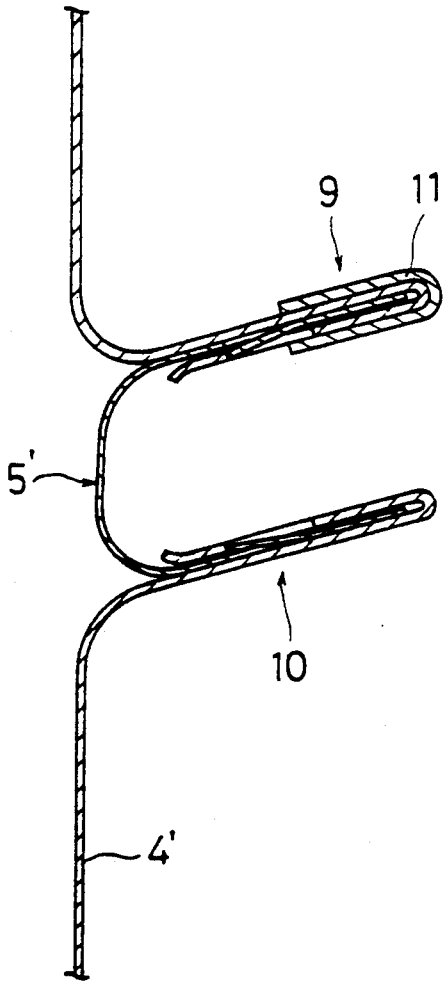
Figure 17C:
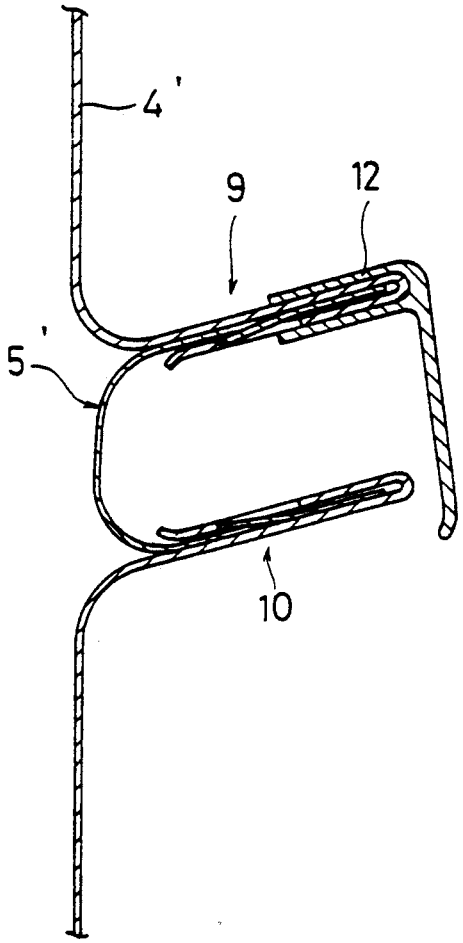
Figure 17D:
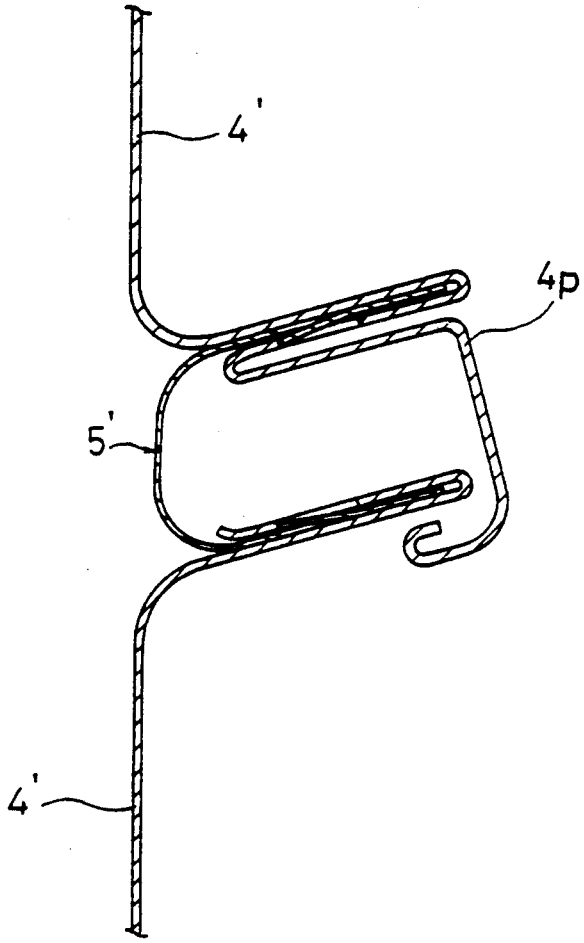

When the shutter curtain 1 is wound to the take-up drum 2, the front portion of the junction 9 comes in contact with the take-up drum 2 or the shutter curtain 1 which has been wound. Therefore, there is a fear that they will be damaged. Accordingly, the junctions 9 and 10 are arranged in such a manner that their inner front portions are rounded by folding back the plate, whereby the damage can be effectively prevented. In order to further improve the function of damage prevention, a structure shown in FIG. 17A may be employed in which the inner front portion is made to be in the form of a rounded shape having an increased diameter. Another structure shown in FIG. 17B may be employed in which a cover 11 is fitted to the junction 9. In this case, the necessity of fitting the cover 11 to the overall length of the junction 9 can be eliminated, and it is therefore partially fitted to the junction 9. If the take-up drum 2 has a large diameter, the ensuing junction 10 will come in contact with the shutter curtain which has been wound. The cover 11 may also be fitted to the ensuing junction 10. Another embodiment is shown in FIG. 17C in which a cover 12 is extended to reach the ensuing junction 10. Furthermore, another embodiment is shown in FIG. 17D in which an extension portion 4p is formed by extending the connection portion of the main slat 4' to the portion of the ensuing junction 10.

Furthermore, if the structure in which the slats 4' and 5' are in the form of the U-shape facing side is arranged in such a manner that the outer surfaces of all of the slats 4' and 5' form a flat plane when they are extended as shown in FIGS. 4F, 40, 4Q and 4S, an advantage can be realized in that the flat plane thus realized can be used as a painting field in which a desired picture, publicity and/or advertisement letters can be smoothly drawn.

The embodiments shown in FIGS. 9 and 13B suggest that the surface of the sub-slat 5' is positioned more adjacent to the take-up drum 2 than the surface of the main slat 4'. In this case, when the surfaces of the sub-slats 5' are curved in order to wind the shutter curtain 1 to the take-up drum 2, the surfaces expand outward due to the fact that the sub-slats 5' are curved. However, the surfaces of the main slats 4' projecting outwards compensate for the above-described expansion. Therefore, a potential problem whereby the sub-slats 5' are damaged because the sub-slats 5' come in contact with the overlapped slat, is effectively prevented. Therefore, the appearance can be maintained satisfactorily for an extended time. The above-described structure is extremely effective as a measure taken to overcome a problem whereby the strength of the sub-slat 5' is inevitably insufficient with respect to the strength of the main slat 4' because the sub-slat 5' must be elastically deformed. Another structure is suggested in which the sub-slats 5' are projected outward over the main slats 4' and the present invention may be applied to the above-described structure.

Furthermore, when the shutter curtain 1 is wound to the take-up drum 2, the shutter curtain 1, which has been wound, will restore to its original state, that is, the flat surface state due to the restoring force of the sub-slats 5' because the sub-slats 5' are elastically deformed. Therefore, a fear arises that the diameter of the wound shutter curtain 1 will be excessively large. The following structure may be employed: the elastical restoring force of the sub-slats 5', which are elastically deformed when they are wound to the take-up drum 2, is arranged to be substantially the same or smaller than the rewinding force of the shutter curtain 1 realized due to the dead weight of the shutter curtain 1 which has been rewound from the take-up drum 2. As a result, when the shutter curtain is wound to the take-up drum 2, the rewinding force due to the dead weight of the rewound shutter curtain 1 becomes the same or larger than the elastic restoring force of the sub-slats 5'. Therefore, the undesirable distortion of the sub-slats 5' in the portion of the shutter curtain 1 which has been wound to the take-up drum 2 can be prevented. As a result, the problem of the excessive expansion of the diameter of the coiled shutter curtain 1 can be assuredly prevented, the excessive expansion being due to loosening of the wound shutter curtain 1.

Figure 18A:
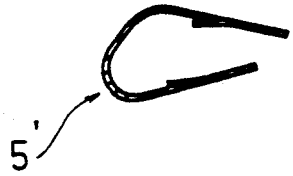
FIGS. 18A and 18B are side elevational cross sectional views which illustrate modified sub-slats.
Figure 18B:
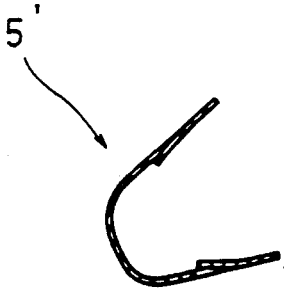

Another means for preventing the expansion of the diameter of the coiled shutter curtain will now be described. The sub-slats 5' are arranged in such a manner that they are naturally forward wound as shown in FIG. 18A in a case where the shutter curtain 1 is, as described above, wound forward. Furthermore, the sub-slats 5' are arranged in such a manner that they are naturally reversely wound as shown in FIG. 18B in a case where the shutter curtain is, as described above, wound forward. In addition, when the shutter curtain 1 is rewound from the take-up drum 2, the sub-slats 5' are elastically deformed due to the weight of the shutter curtain 1 which has been rewound. As a result, the attitude can be corrected and a flat surface for the sub-slats is realized. According to the structure thus-constituted, the problems of an excessive expansion of the coil diameter due to the restoring force of the sub-slats when the shutter curtain 1 is wound can be prevented. Furthermore, winding of the shutter curtain 1 can be smoothly performed during winding of the shutter curtain 1 performed against the dead weight of the rewound shutter curtain 1.

Although the invention has been described in its preferred forms with particularity, it is understood that the present disclosure of the preferred form may be changed in the details of construction and in the combination and arrangement of parts without departing from the spirit and the scope of the invention as hereinafter claimed.

What is claimed is:

1. A shutter curtain for a building opening for raising/lowering an opening portion, said shutter curtain comprising:

main slats made of a rigid material; and sub-slats made of a material having elasticity, each of said main slats and said sub-slats having a slat surface, wherein two end portions of said main and sub-slats are connected in series to form said shutter curtain, wherein said main slats and said sub-slats are positioned adjacently, said shutter curtain being wound to a take-up drum to form a coil-like shape due to elastic deformations of said sub-slats and said sub-slats are curved to be adapted to be wound to said take-up drum.

2. A shutter curtain for a building opening according to claim 1, wherein at least one of said main slats and said sub-slats is bent in the form of a U-like-shape.

3. A shutter curtain for a building opening according to claim 1, wherein at least one of said main slats and said sub-slats is bent in the form of a Σ-like-shape.

4. A shutter curtain for a building opening according to claim 1, wherein at least one of said main slats and said sub-slats is bent in the form of a substantially semicircular shape.

5. A shutter curtain for a building opening according to claim 1, wherein at least one of slat surfaces is in a waveform.

6. A shutter curtain for a building opening according to claim 1, wherein at least one of slat surfaces in the form of a zigzag shape.

7. A shutter curtain for a building opening according to claim 1, wherein at least one of slat surfaces is in the form substantially composed of projections and recesses.

8. A shutter curtain for a building opening according to claim 1, wherein at least one of said main slat and said sub-slats is a hollow type sub-slats.

9. A shutter curtain for a building opening according to claim 1, wherein the two end portions of each of said main slats and said sub-slats project toward the inside portion of the building, said main slats and said sub-slats are respectively in the form of a U-like-shape having recessed portions in projected portions of said main slats and said sub-slats, the two end portions of said slats positioned adjacently are connected in series to each other to form said shutter curtain.

10. A shutter curtain for a building opening according to claim 9, wherein said recessed portions formed in said main slats are filled with heat insulating material.

11. A shutter curtain for a building opening according to claim 9, wherein said recessed portions formed in said sub-slats are filled with heat insulating material.

12. A shutter curtain for a building opening according to claim 9, wherein said recessed portions formed in said both said main slats and said sub-slats are filled with heat insulating material.

13. A shutter curtain for a building opening according to claim 12, wherein said heat insulating material injected into said sub-slats is a material having elasticity.

14. A shutter curtain for a building opening according to claim 1, wherein said shutter curtain is wound to said take-up drum due to an elastical restoring force which is arranged to be no greater than a curtain rewinding force of said shutter curtain, which has been rewound from said take-up drum.

15. A shutter curtain for a building opening according to claim 1, wherein said end portions of said slats positioned adjacently are bent to either side of the slat surface of said shutter curtain and bent portions of said slats are connected to connect said slats positioned adjacently.

16. A shutter curtain for a building opening according to claim 1, wherein said end portions of said slats positioned adjacently are bent toward the inside portion of the building and said end portions, which have been bent, are integrally secured to each other to form a series of connected shapes.

17. A shutter curtain for a building opening according to claim 1, wherein said end portions of said slats positioned adjacently are bent toward the inside portion of the building, said bent portions are integrally secured to each other so as to be connecting portions for realizing a series of connected bodies and at least one of said connecting portions is further folded back to form overlapped connecting portions.

18. A shutter curtain for a building opening according to claim 1, wherein a holding groove portion having an opening facing said slats positioned adjacently is formed in at least either of said end portions of said slats which are positioned adjacently and another end portion is fitted within said holding groove so as to be connected in series.

19. A shutter curtain for a building opening according to claim 1, said two end portions of one of said adjacent slats having holding grooves projecting toward the inside portion of the building and having openings facing the outside portion of the building, and projecting fastening portions formed toward the inside portion of the building in the two end portions of another slat are forcibly fitted within said holding grooves so as to form a series of connected bodies.

20. A shutter curtain for a building opening according to claim 1, wherein said main slats and said sub-slats are alternately connected, said two end portions of said main slats having holding grooves projecting toward the inside portion of the building and having openings facing the outside portion of the building, and projecting fastening portions formed toward the inside portion of the building in the two end portions of said sub-slats are forcibly fitted within said holding grooves so as to form a series of connected bodies.

21. A shutter curtain for a building opening according to claim 1, wherein said two end portions of said main slats have holding grooves projecting toward the inside portion of the building and have openings facing the outside portion of the building, projecting fastening portions formed toward the inside portion of the building in the two end portions of said sub-slats are forcibly fitted within said holding grooves so as to form a series of connected bodies and a front portion of said fastening portion is bent to expand outward.

22. A shutter curtain for a building opening according to claim 1, wherein said two end portions of one of said adjacent slats having holding grooves projecting toward the inside portion of the building and having openings facing the outside portion of the building, projecting fastening portions formed toward the inside portion of the building in the two end portions of another slat are forcibly fitted within said holding grooves so as to form a series of connected bodies and front portions of said connected bodies are in the form of a rounded shape.

23. A shutter curtain for a building opening according to claim 1, wherein said main slats and said sub-slats are alternately connected, said two end portions of said sub-slats having holding grooves projecting toward the inside portion of the building and having openings facing the outside portion of the building and projecting fastening portions formed toward the inside portion of the building in the two end portions of said main slat are forcibly fitted within said holding grooves so as to form a series of connected bodies.

24. A shutter curtain for a building opening according to claim 1, wherein said two end portions of one of said adjacent slats have holding grooves projecting toward the inside portion of the building and have openings facing the outside portion of the building, projecting fastening portions formed toward the inside portion of the building in the two end portions of another slat are forcibly fitted within said holding grooves so as to form a series of connected bodies and the slat surfaces of said adjacent slats form a flat surface.

25. A shutter curtain for a building opening according to claim 1, wherein said take-up drum is disposed in a shutter case, said two end portions of said main slats having holding grooves projecting toward the inside portion of the building and having openings facing the outside portion of the building, projecting fastening portions formed toward the inside portion of the building in the two end portions of said sub-slats are forcibly fitted within said holding grooves so as to form a series of connected bodies, said shutter curtain is wound to said take-up drum due to an elastic deformation of said sub-slats and the surfaces of said subs-slats are positioned more adjacently to said take-up drum than the surfaces of said adjacent main slats.

26. A shutter curtain for a building opening according to claim 1, wherein said two end portions of one of said adjacent slats have holding grooves projecting toward the inside portion of the building and have openings facing the outside portion of the building, projecting fastening portions formed toward the inside portion of the building in the two end portions of another slat are forcibly fitted within said holding grooves so as to form a series of junctions and connected bodies and a cover is fastened to the junctions of said slats from the inside portion of the building.

27. A shutter curtain for a building opening according to claim 26, wherein said take-up drum is disposed in a shutter case and said cover is at least fastened to a leading junction of said junctions when they are wound to said take-up drum with respect to said sub-slats.

28. A shutter curtain for a building opening according to claim 26, wherein said cover is fastened to one of said junctions and said cover is extended to cover another of said junctions.

29. A shutter curtain for a building opening according to claim 1, wherein junctions projecting toward the inside portion of the building are formed in the two end portions of each of said slats, said junctions are overlapped to integrally form a connected body and either of said junctions has a cover extending to another junction to cover the other junction.

30. A shutter curtain for a building opening according to claim 1, wherein junctions projecting toward the inside portion of the building are formed in the two end portions of each of said slats, said junctions are overlapped to be integrally connected, said shutter curtain is structured so as to be curved due to an elastic deformation of said sub-slats, a fastening portion extending to said sub-slats is formed in said junctions of said main slats, wherein said fastening portions are positioned adjacently and are fastened to each other at said sub-slats by bending them.

31. A shutter curtain for a building opening according to claim 1, wherein said take-up drum is disposed in a shutter case, said main slats and said sub-slats being alternately disposed, junctions projecting toward the inside portion of the building are formed in the two end portions of said main slats, junctions projecting toward the inside portion of the building and formed in the two end portions of said sub-slats are overlapped to said junctions of said main slats so as to be integrally connected, said overlapped junctions of said sub-slats defining a leading junction and a following junction, said leading junction being wound to said take-up drum prior to said following junction, said shutter curtain being structured to be wound to said take-up drum due to an elastic deformation of said sub-slats to form a coil-like shape, wherein said following junction is arranged to be positioned radially outside of said leading junction when said shutter curtain has been wound to said take-up drum.

32. A shutter curtain for a building opening according to claim 1, wherein said take-up drum is disposed in a shutter case, said main slats and said sub-slats being alternately disposed, junctions projecting toward the inside portions of said main slats, junctions projecting toward the inside of the building and formed in the two end portions of said sub-slats are overlapped to said junctions of said main slats so as to be integrally connected, said shutter curtain is structured to be would to said take-up drum due to an elastic deformation of said sub-slats to form a coil-like shape and said two junctions across the surface of said sub-slats which are elastically deformed are brought into contact with each other within their elastic deformation, below their elastic limit, so as to prevent further elastic deformations of said sub-slats.

33. A shutter curtain for a building opening according to claim 1, wherein said main slats and said sub-slats are alternately connected to each other, holding groove portions projecting toward the inside portion of the building and having an opening facing the outside portion of the building are formed in the two end portions of said main slats, projecting fastening portions toward the inside portion of the building formed in the two end portions of said sub-slats are forcibly fitted within said holding groove portions, fastening holes are formed in said holding groove portions, fastening members having expanding surfaces confronting the surface of said slats are formed in said fastening portions by cutting and said fastening members are fastened to said fastening holes by forcibly fitting said fastening portions into said holding grooves so that said fastening portions are stopped.

34. A shutter curtain for a building opening according to claim 1, wherein said main slats and said sub-slats are alternately connected, said two end portions of said main slats having holding grooves projecting toward the inside portion of the building and having openings facing the outside portion of the building and projecting fastening portions formed toward the inside portion of the building in the two end portions of said sub-slats are forcibly fitted within said holding grooves, fastening holes are formed in said holding groove portions and fastening members to be fastened into said fastening holes are formed in said fastening portions in such a manner that any one side in a lengthwise direction of said sub-slats is moderately expanded so as not to be fastened into said fastening hole and the other sides are expanded to form a step so as to be fastened to said fastening hole.

35. A shutter curtain for a building opening according to claim 1, wherein said main slats and said sub-slats are alternately connected, said two end portions of said main slats having holding grooves projecting toward the inside portion of the building and having openings facing the outside portion of the building and projecting fastening portions formed toward the inside portion of the building in the two end portions of said sub-slats are forcibly fitted within said holding groves, fastening holes are formed in said holding groove portions and fastening members to be fastened into said fastening holes are formed in said fastening portions in such a manner that said two end portions in the lengthwise direction of said sub-slats are moderately expanded so as not to be fastened into said fastening hole and the two end portions in the direction in which said fastening portion is forcibly inserted is expanded to form a step so as to be fastened to said fastening hole.

36. A shutter curtain for a building opening according to claim 1, wherein said main slats and said sub-slats are alternately connected, said two end portions of said main slats having holding grooves projecting toward the inside portion of the building and having openings facing the outside portion of the building and projecting fastening portions formed toward the inside portion of the building in the two end portions of said sub-slats are forcibly fitted within said holding groves, fastening holes are formed in said holding groove portions and fastening members to be fastened into said fastening holes are formed in said fastening portions in such a manner that sides composed of the two end portions in the lengthwise direction of said sub-slats and a side in a direction into which said fastening portion is fastened into said fastening hole are expanded moderately so as not to be fastened to said fastening hole and only a side opposite to said fastening direction is expanded to form a step so as to be fastened into said fastening hole.

37. A shutter curtain for a building opening according to claim 1, wherein said shutter curtain is guided by a vertically disposed guide rail so as to vertically raise/lower over said opening, holding groove portions projecting toward the inside portion of the building and having openings facing the outside portion of the building are formed in the two end portions of either of said slats and projecting fastening portions toward the inside portion of the building formed in the two end portions of the other slats are forcibly fitted within said holding groove portions so that said main slats and said sub-slats are connected in series.

38. A shutter curtain for a building opening according to claim 1, said opening having two lateral end portions, wherein said shutter curtain is guided by a pair of vertically disposed guide rails positioned on the two lateral end portions of said opening so as to move vertically to raise/lower over said opening, holding groove portions projecting toward the inside portion of the building and having openings facing the outside portion of the building are formed in the two end portions of either of said slats positioned adjacently, projecting fastening portions toward the inside portion of the building formed in the two end portions of the other slats are forcibly fitted within said holding groove portions so that said main slats and said sub-slats are connected in series and junctions of said slats are respectively inclined in such a manner that their portion facing the outside portion of the building is positioned at a relatively lower position and their portion facing the inside portion of the building is positioned at a relatively higher position.

39. A shutter for a building opening according to claim 1, wherein said shutter curtain is guided by a pair of horizontally disposed guide rails so as to laterally open/close over said opening, holding groove portions projecting toward the inside portion of the building and having openings facing the outside portion of the building are formed in the two end portions of either of said slats and projecting fastening portions toward the inside portion of the building formed in the two end portions of the other slats are forcibly fitted within said holding groove portions so that said main slats and said sub-slats are connected in series.

40. A shutter curtain for a building opening according to claim 11, wherein said heat insulating material injected into said sub-slats is a material having elasticity.

41. A shutter curtain for a building opening according to claim 12, wherein said heat insulating material injected into said sub-slats is a material having elasticity.

42. A shutter curtain for a building opening according to claim 15, wherein said end portions of said slats positioned adjacently are bent toward the inside portion of the building and said end portions, which have been bent, are integrally secured to each other to form a series of connected shapes.

43. A shutter curtain for a building opening according to claim 15, wherein said end portions of said slats positioned adjacently are bent toward the inside portion of the building, said bent portions are integrally secured to each other so as to be connecting portions for realizing a series of connected bodies and at least one of said connecting portions is further folded back to form overlapped connecting portions.

44. A shutter curtain for a building opening according to claim 16, wherein said end portions of said slats positioned adjacently are bent toward the inside portion of the building, said bent portions are integrally secured to each other so as to be connecting portions for realizing a series of connected bodies and at least one of said connecting portions is further folded back to form overlapped connecting portions.

45. A shutter curtain for a building opening according to claim 15, wherein said main slats and said sub-slats are alternately connected, said two end portions of said main slats having holding grooves projecting toward the inside portion of the building and having openings facing the outside portion of the building, and projecting fastening portions formed toward the inside portion of the building in the two end portions of said sub-slats are forcibly fitted within said holding grooves so as to form a series of connected bodies.

46. A shutter curtain for a building opening according to claim 19, wherein said two end portions of said main slats have holding grooves projecting toward the inside portion, of the building and have openings facing the outside portion of the building, projecting fastening portions formed toward the inside portion of the building in the two end portions of said sub-slat are forcibly fitted within said holding grooves so as to form a series of connected bodies and a front portion of said fastening portion is bent to expand outward.

47. A shutter curtain for a building opening according to claim 20, wherein said two end portions of said main slats have holding grooves projecting toward the inside portion of the building and have openings facing the outside portion of the building, projecting fastening portions formed toward the inside portion of the building in the two end portions of said sub-slats are forcibly fitted within said holding grooves so as to form a series of connected bodies and a front portion of said fastening portion is bent to expand outward.

48. A shutter curtain for a building opening according to claim 19, wherein said two end portions of one of said adjacent slats have holding grooves projecting toward the inside, portion of the building and have openings facing the outside portion of the building, projecting fastening portions formed toward the inside portion of the building in the two end portions of another slat are forcibly fitted within said holding grooves so as to form a series of connected bodies and a front portion of the junction of said connected portion is in the form of a rounded shape.

49. A shutter curtain for a building opening according to claim 19, wherein said main slats and said sub-slats are alternately connected, said two end portions of said sub-slats having holding grooves projecting toward the inside portion of the building and having openings facing the outside portion of the building and projecting fastening portions formed toward the inside portion of the building in the two end portions of said main slats are forcibly fitted within said holding grooves so as to form a series of connected bodies.

50. A shutter curtain for a building opening according to claim 19, wherein said two end portions of one of said adjacent slats have holding grooves projecting toward the inside portion of the building and have openings facing the outside portion of the building, projecting fastening portions formed toward the inside portion of the building in the two end portions of another slat are forcibly fitted within said holding grooves so as to form a series of connected bodies and the slat surfaces of said adjacent slats form a flat surface.

51. A shutter curtain for a building opening according to claim 19, wherein said take-up drum is disposed in a shutter case, said two end portions of said main slats having holding grooves projecting toward the inside portion of the building and having openings facing the outside portion of the building, projecting fastening portions formed toward the inside portion of the building in the two end portions of said sub-slats are forcibly fitted within said holding grooves so as to form a series of connected bodies, said shutter curtain is wound to said take-up drum due to an elastic deformation of said sub-slats and the slat surfaces of said sub-slats are positioned more adjacently to said take-up drum than the slat surfaces of said adjacent main slats.

52. A shutter curtain for a building opening according to claim 19, wherein said two end portions of one of said adjacent slats have holding grooves projecting toward the inside portion of the building and have openings facing the outside portion of the building, projecting fastening portions formed toward the inside portion of the building in the two end portions of another slat are forcibly fitted within said holding grooves so as to form a series of junctions and connected bodies and a cover is fastened to the junctions of said slats from the inside portion of the building.

53. A shutter curtain for a building opening according to claim 33, wherein said main slats and said sub-slats are alternately connected, said two end portions of said main slats having holding grooves projecting toward the inside, portion of the building and having openings facing the outside portion of the building and projecting fastening portions formed toward the inside portion of the building in the two end portions of said sub-slats are forcibly fitted within said holding grooves, fastening holes are formed in said holding groove portions and fastening members to be fastened into said fastening holes are formed in said fastening portions in such a manner that any one side in the lengthwise direction of said sub-slats is moderately expanded so as not to be fastened into said fastening hole and the other sides are expanded to form a step so as to be fastened to said fastening hole.

54. A shutter curtain for a building opening according to claim 33, wherein said main slats and said sub-slats are alternately connected, said two end portions of said main slats having holding grooves projecting toward the inside portion of the building and having openings facing the outside portion of the building and projecting fastening portions formed toward the inside portion of the building in the two end portions of said sub-slats are forcibly fitted within said holding grooves, fastening holes are formed in said holding groove portions and fastening members to be fastened into said fastening holes are formed in said fastening portions in such a manner that said two end portions in a lengthwise direction of said sub-slats are moderately expanded so as not to be fastened into said fastening hole and the two end portions in a direction in which said fastening portion is forcibly inserted is expanded to form a step so as to be fastened to said fastening hole.

55. A shutter curtain for a building opening according to claim 33, wherein said main slats and said sub-slats are alternately connected, said two end portions of said main slats having holding grooves projecting toward the inside portion of the building and having openings facing the outside portion of the building and projecting fastening portions formed toward the inside portion of the building in the two end portions of said sub-slats are forcibly fitted within said holding grooves, fastening holes are formed in said holding groove portions and fastening members to be fastened into said fastening holes are formed in said fastening portions in such a manner that sides composed of the two end portions in a lengthwise direction of said sub-slats and a side in a direction into which said fastening portion is fastened into said fastening hole are expanded moderately so as not to be fastened to said fastening hole and only a side opposite to said fastening direction is expanded to form a step so as to be fastened into said fastening hole.

56. A shutter curtain for a building opening according to claim 37, said opening having two lateral end portions, wherein said shutter curtain is guided by a pair of vertically disposed guide rails positioned on the two lateral end portions of said opening so as to move vertically to raise/lower over said opening, holding groove portions projecting toward the inside portion of the building and having openings facing the outside portion of the building are formed in the two end portions of either of said slats positioned adjacently, projecting fastening portions toward the inside portion of the building formed in the two end portions of the other slats are forcibly fitted within said holding groove portions so that said main salts and said sub-slats are connected in series and junctions of said slats are respectively inclined in such a manner that their portion facing the outside portion of the building is positioned at a relatively lower position and their portion facing the inside portion of the building is positioned at a relatively higher position.

57. A shutter curtain for a building opening for raising/lowering an opening portion, the building having an inside portion and an outside portion, said shutter curtain comprising:

main slats made of a rigid material; and sub-slats made of a material having elasticity, each of said main slats and said sub-slats having a slat surface, wherein two end portions of said main and sub-slats are connected in series to form said shutter curtain, wherein said main slats and said sub-slats are positioned adjacently, said two end portions of one of said adjacent slats having holding grooves projecting toward the inside portion of the building and having openings facing the outside portion of the building, projecting fastening portions formed toward the inside portion of the building in the two end portions of another slat are forcibly fitted within said holding grooves so as to form a series of connected bodies, wherein front portions of said connected bodies are in the form of a rounded shape.

58. A shutter curtain for a building opening for raising/lowering an opening portion, said building having an inside portion and an outside portion, said shutter curtain comprising:

main slats made of a rigid material; and sub-slats made of a material having elasticity, each of said main slats and said sub-slats having a slat surface, wherein two end portions of said main and sub-slats are connected in series to form said shutter curtain, wherein said main slats and said sub-slats are positioned adjacently, said opening having two lateral end portions, wherein said shutter curtain is guided by a pair of vertically disposed guide rails positioned on the two lateral end portions of said opening so as to move vertically to raise/lower over said opening, holding groove portions projecting toward the inside portion of the building and having openings facing the outside portion of the building are formed in the two end portions of either of the slats positioned adjacently, projecting fastening portions toward the inside portion of the building formed in the two end portions of the other slats are forcibly fitted within said holding groove portions so that said main slats and said sub-slats are connected in series and junctions of said slats are respectively inclined in such a manner that their portion facing the outside portion of the building is positioned at a relatively lower position and their portion facing the inside portion of the building is positioned at a relatively higher position.

* * * * *